US005771984A

United States Patent [19]

Potter et al.

[11] Patent Number: 5,771,984

[45] Date of Patent: Jun. 30, 1998

[54] CONTINUOUS DRILLING OF VERTICAL BOREHOLES BY THERMAL PROCESSES: INCLUDING ROCK SPALLATION AND FUSION

[75] Inventors: Robert M. Potter, Los Alamos, N. Mex.; Jefferson W. Tester, Hingham, Mass.

[73] Assignee: Massachusetts Institute of Technology, Cambridge, Mass.

[21] Appl. No.: 445,330

[22] Filed: May 19, 1995

[51] Int. Cl.[6] ..... E21B 7/14; E21B 7/15

[52] U.S. Cl. ..... 175/14; 175/15

[58] Field of Search ..... 175/15, 14, 12, 175/17, 424; 299/14

[56] References Cited

U.S. PATENT DOCUMENTS

| | | | |
|---|---|---|---|
| 2,518,591 | 8/1950 | Aston et al. | 175/213 X |
| 2,990,653 | 7/1961 | Browning | 51/8 |
| 3,045,766 | 7/1962 | Fleming, Jr. | 175/15 X |
| 3,103,251 | 9/1963 | Browning | 175/14 |
| 3,182,734 | 5/1965 | Scott | 175/15 X |
| 3,255,802 | 6/1966 | Browning | 158/4 |
| 3,322,213 | 5/1967 | Arnold et al. | 175/15 X |
| 3,476,194 | 11/1969 | Browning | 175/14 |
| 3,576,222 | 4/1971 | Acheson et al. | 175/424 X |
| 3,620,313 | 11/1971 | Elmore et al. | 175/14 |
| 3,792,741 | 2/1974 | Hopler, Jr. | 175/11 |
| 3,835,937 | 9/1974 | Hokao et al. | 175/6 |
| 3,844,362 | 10/1974 | Elbert et al. | 166/223 X |
| 4,073,351 | 2/1978 | Baum | 175/14 |
| 4,301,875 | 11/1981 | Munding et al. | 175/14 X |
| 4,776,638 | 10/1988 | Hahn | 299/5 |

FOREIGN PATENT DOCUMENTS

| | | | |
|---|---|---|---|
| 405039696 | 2/1993 | Japan | 175/424 |
| 405156884 | 6/1993 | Japan | 175/424 |

OTHER PUBLICATIONS

Browning et al., "Recent Advances in Flame–jet Working of Minerals," 7th Symp. Rock Mech., Pennsylvania State Univ., University 1 J.A. Browning et al., Recent Advances in Park (1965).

J.J. Calaman et al., "Technical Advances Expand Use of Jet–Piercing Process in Taconite Industry," Int. Symp. Mining Res., Univ. of Missouri, Columbia (1961).

Rauenzahn et al., "Flame–jet Induced Thermal Spallation as a Method of Rapid Drilling and Cavity Formation," Proc. 60th Assn. Tech. Conf. and Exhibition, Sox Petrol. Eng. paper 14331, Las Vegas, NV (1985).

Rauenzahn et al., "Rock Failure Mechanisms of Flame–jet Thermal Spallation Drilling—Theory and Experimental Testing," *Int. J. Rock Mech. Min. Sci. Geomech. Abst.* 26(5), pp. 381–399 (1989).

(List continued on next page.)

*Primary Examiner*—Hoang C. Dang
*Attorney, Agent, or Firm*—Steven J. Weissburg

[57] ABSTRACT

Various rock spallation devices and methods reduce the cost of deep hole excavation. A spallation head has rotating, circumferentially spaced jets. The jets may be combustion flame jets or very hot water. In a combustion embodiment, air and water are delivered to the spallation apparatus downhole in a mixture, and are separated. In a low density embodiment, the borehole is essentially empty. In a high density embodiment, more water is included in the mixture of air and water, and the borehole is filled with fluid. Instead of combustion, the kinetic energy of flowing water at the spallation device can be used to power a turbogenerator that generates electric energy to heat the water and spall the rock. The jets may also be aimed and configured to fuse the excavation material, if spallation is not feasible. New lengths of feed and return pipe can be added while spallation continues uninterrupted, either due to well head alternating equipment, or a downhole relative motion device.

35 Claims, 28 Drawing Sheets

OTHER PUBLICATIONS

Williams et al., "Experiments in Thermal Spallation of Various Rocks," The American Society of Mechanical Engineers, paper 93–PET0–09, New York, NY (1993).

Rauenzahn et al., "Numerical Simulation and Field Testing of Flame–jet Thermal Spallation Drilling—1. Model Development," and 2. Experimental Verification, *Int. J. Heat Mass Transfer*, 34(3), pp. 795–818 (1991).

M.A. Wilkinson et al., "Computational modeling of the gas–phase transport phenomena during flame–jet thermal spallation drilling," *Int. J. Heat Mass Transfer*, 36(14), pp. 3459–3475 (1993).

Wilkinson et al., "Experimental Measurement of Surface Temperatures During Flame Jet Induced Thermal Spallation," *Rock Mechanics and Rock Engineering*, 26(1), pp. 29–62 (1993).

E.E. Anderson et al., "Heat Transfer from Flames Impinging on Flat and Cylindrical Surfaces," *Journal of Heat Transfer*, pp. 49–54 (1963).

B.N. Pamadi et al., "A Note on the Heat Transfer Characteristics of Circular Impinging Jet," *Int. J. Heat Mass Transfer*, pp. 783–787 (1980).

Cz.O. Popiel, et al., "Convective Heat Transfer on a Plate in an Impinging Rount Hot Gas Jet of Low Reynolds Number," *Int. J. Heat Mass Transfer*, 23, pp. 1055–1068 (1980).

R.E. Williams, "The Thermal Spallation Drilling Process," *Geothermics*, 15, No. 1, pp. 17–22 (1986).

R.E. Williams et al., "Advancements in Thermal Spallation Drilling Technology," Los Alamos National Laboratory publication, LA 11391 MS, UC 702, issued Sep. 1988.

CONTINUOUS DRILLING OF VERTICAL BOREHOLES BY THERMAL PROCESSES: INCLUDING ROCK SPALLATION AND FUSION

BACKGROUND

The present invention relates generally to geological excavation and relates more specifically to drilling very deep, essentially vertical boreholes. The invention pertains to a novel apparatus for generating such deep boreholes by a variety of thermal processes ranging from flame jet spallation to a combination with fusion or melting, and a method for using such a novel apparatus.

Conventional rotating strings, for drilling deep (10,000 to 15,000 ft (3.2 to 4.6 km)) and ultra-deep (greater than 33,000 ft (10 km)) holes in stable rock formations employing mechanical failure mechanisms (crushing, grinding, and general abrasion) to penetrate are ultimately limited by the forces of friction and material wear. The mechanics of rotary drilling cause the borehole to deviate from the vertical, with consequent increasing frictional forces. The direct mechanical contact at the drilling face causes non-vertical holes. Further, the direct contact of the drill bit with the hard, abrasive material being removed (along with induced heating) results in irreversible equipment and tool wear, leading ultimately to failure of the drilling process itself. A recent improvement in drilling efficiency, demonstrated in the ultradeep German "KTB" hole, emphasizes verticality to minimize wear (see *Science,* Vol. 261, pp. 295–297, 16 Jul. 1993).

It is desirable in a rock removal system to minimize or entirely avoid mechanical contact between the removal apparatus and the rock being removed. This would minimize any tendency of the removal apparatus to deviate from a vertical orientation. It is also desirable to eliminate the need for rotation of the major portion of the apparatus, commonly implemented as rotation of the entire drill string. Such rotation causes friction between the apparatus and the borehole wall. The frictional forces contribute to the tendency to deviate from verticality. Rotation also complicates the design of joints between pipe lengths and the process of adding pipe lengths to drill a deeper hole. Rotation also generates the potential for high degrees of friction along the entire depth of the hole being made. Another problem inherent with a rotating drill string is that it is difficult to communicate between the surface and sub-surface equipment using cables outside of the drill string. Such a capability is highly desirable, to provide the ability to monitor and control down-hole activities.

It is very desirable that the only forces imposed upon hole forming apparatus be tensile oriented vertically along the axis of the drill string of pipes. It is easier to design apparatus to withstand such forces. Further, it is the non-tensile forces that cause the hole forming apparatus to deviate from the vertical, thus generating a non-vertical hole.

It is also desirable to be able to create a hole having a diameter that is larger than the diameter of the equipment used to create the hole. This arrangement is known as "underreaming." Without underreaming, the tool wears down, which results in a gradually narrowing, tapered hole. A reaming operation is required before a fresh drilling bit can further deepen the hole. This is undesirable. Controlled diameter holes are preferred. An underreaming capability would reduce the cost of the equipment, relative to the diameter of the hole, and provide clearance for additional equipment and activities, such as rock removal.

It is known to use rapid thermal spallation to remove rock. Spallation can achieve some of the foregoing objectives. However, known spallation techniques have drawbacks. In a known spallation procedure, a combustion flame jet impinges on a rock surface, thereby inducing stresses high enough to cause the rock to spall (J. A. Browning, "Flame Cutting Method," U.S. Pat. No. 3,103,251, Jun. 19, (1957); J. A. Browning, W. B. Horton and H. L. Hartman, "Recent Advances in Flame-jet Working of Minerals," 7th Symp. Rock Mech., Pennsylvania State Univ., University Park (1965); J. J. Calaman and H. C. Rolseth, "Technical Advances Expand Use of Jet-Piercing Process in Taconite Industry," Int. Symp. Mining Res., Univ. of Missouri, Columbia (1961)). The mechanical action of the jet combustion gases removes the spall from the excavation site. Field experience has shown that thermal spallation rock removal intrinsically results in "underreaming" in a controlled fashion (R. M. Rauenzahn and J. W. Tester, "Flame-jet Induced Thermal Spallation as a Method of Rapid Drilling and Cavity Formation," Proc., 60th Assn. Tech. Conf. and Exhibition, Soc. Petrol. Eng. paper 14331, Las Vegas Nev. (1985) and "Rock failure Mechanisms of Flame-jet Thermal Spallation Drilling—Theory and Experimental Testing, *Int. J. Rock Mech. Min. Sci. Geomech. Abst.* 26(5). pp. 381–399 (1989); R. E. Williams, R. M. Potter and S. Miska, "Experiments in Thermal Spallation of Various Rocks," The American Society of Mechanical Engineers paper 93-PET-9, New York, N.Y. (1993)).

A spallation drilling rig need not use rotation of the drill string. Further, there is no direct contact between the effective end of the apparatus and the rock being removed, so it is possible to avoid wear caused by abrasion at the tool-rock interface. (The wellbore should be large enough, relative to the tool diameter, to reduce abrasion of the tool from contact with high velocity spalls, as they leave the working excavation face of the rock.) Further, there are no forces to disrupt verticality.

A spallation apparatus of the prior art is shown schematically in FIG. 1. A pipe assembly 102 is introduced into a hole 104 in a rock formation 106. Fuel and air are provided to a combustion chamber 112 through respective fuel 108 and air 110 supply lines. The high temperature combustion products exit through a nozzle 114 generating a supersonic axial flame jet 116. The flame jet 116 heats the rock 106 directly beneath it at a central region 118, known as a "hydrodynamic singularity." Cooling fluid flows through the drilling system in a passageway 120 exiting into the hole 104 at a port 122. The cooling fluid mixes with the hot combustion gases and spalls, cooling them to a safe state. The exiting combustion gases are typically not sufficient to lift the spalled rock away from the removal site, up the hole 104 to the surface. To do so, additional air must be provided.

Known spallation methods, as shown in FIG. 1, suffer from a drawback of overheating at the hydrodynamic singularity, region 118 of the hole. Overheating arises because all of the thermal flux needed to generate the entire hole is delivered over one small region, which is centered about the axis of the hole. This flux must be great enough to also bring about spallation at locations distant from the hole axis. The result is that the highest heat flux is provided at a radial location having the least amount of rock to be removed, i.e., the center.

This situation results in inefficiencies. Further, some types of rock will not spall if heat flux above a maximum is provided. Spallation happens due to differential thermal stresses within a relatively brittle material, that are relieved by tensile failure of the brittle rock at loci of high stresses.

If, however the material is heated to a temperature above its brittle-to-ductile transformation, the ductile material will deform plasticly—flowing or changing its shape to reduce its internal stresses. Thus, in these situations, no spallation will occur.

Consequently, overheating will result ultimately in fusion of specific mineral components at that thermodynamic melting point which severely impedes the spallation process and fouls the spallation equipment if it comes in contact with the molten material. Further, the molten rock cannot be easily removed by the spallation apparatus, and it is more resistant to spalling after resolidification.

Another limitation with conventional spallation techniques is that some rock types are not practically spallable.

Spallation techniques are not considered to be useful for very deep holes, because known flame jet spallation is typically a low density operation. The hole being formed is filled with spent combustion gases, at essentially atmospheric pressure. Such essentially "empty" holes may not withstand local borehole stresses, and may collapse due to such stresses.

Known drilling and hole formation techniques also become increasingly expensive as the hole becomes deeper. As shown graphically in FIG. 2, an eight km (26,500 ft) oil or gas well drilled by advanced "conventional" techniques, incorporating state-of-the-art composite polycrystalline diamond compact (or "PDC") tungsten carbide bits and carefully controlled drilling parameters (weight on bit, rotational speed, etc.) would cost more than $20 million (1991 dollars) on average. Extrapolating to 10 km (33,000 ft) along the advanced conventional technology line in FIG. 2, costs quickly escalate to $60 million or more.

The shaded region represents the experience derived from drilling hot dry rock ("HDR") and conventional hydrothermal geothermal wells. The problem-burdened line shows a worst case, with the resulting highest costs for geothermal wells based on current drilling practices. The base case represents average costs for geothermal heat mining holes in hot dry rock based on current drilling practices. The advanced conventional technology represents anticipated improvement to rotary drilling technology. The oil and gas average line is an average of essentially all oil and gas wells, drilled in the present era as reported by the Joint Association Survey (JAS). The linear drilling technology line theoretically represents the use of drilling technology fundamentally different than rotary practice, such as is proposed by the present invention. No linear drilling technology other than that of the present invention now exists. As can be seen, significant savings are projected based on the invention, even over advanced conventional technology.

Any hardware repair or replacement typically requires removing the drilling equipment from the hole, followed by subsequent replacement of the equipment to the bottom of the hole. Such down time with no drilling occurring is undesirable. The cost of drilling a well using conventional methods generally increases exponentially with depth (i.e., well cost=$A^{BZ}$, where A and B are fitted constants and Z=depth). Exponential dependence characterizes virtually all previous experience with oil, gas, and geothermal drilling using conventional rotary methods that are interrupted by materials wear and failure requiring replacement of downhole hardware (bits, tool joints, shock subs, etc.).

Thus, the several objects of the invention include creation of very deep, essentially vertical boreholes at a relatively low cost, or at least at a cost below one represented by the exponential relation between cost and depth for conventional methods. Another object of the invention is to reduce the wear of hole excavation equipment and the necessary time spent repairing or accommodating such wear. Another object is to create very deep holes relatively quickly. Still another object of the invention is to facilitate communication through wires or cables between the surface of a drilling facility and down-hole locations. This would provide control capabilities, and transmission of down-hole borehole physical measurements. Yet another object of the invention is to reduce non-axial stresses on equipment used in creating deep boreholes. It is another object of the invention to create a hole without direct physical contact between the hole creating apparatus and the rock being removed. It is also desirable to avoid overheating of the rock by the spallation device. Another object of the invention is to create a hole by "underreaming," which is larger in diameter than the apparatus used to create it. Another object is to support the walls of a hole being formed from collapse due to stresses in the surrounding rock. Another object is to form a borehole with an arbitrary diameter, relative to the excavating apparatus. Still another object of the invention is to continuously form a hole, while adding new lengths of pipe at the surface for fuel, or return, or both. It is also desirable to use spallation to form a borehole, and to provide the appropriate amount of heat flow to the appropriate surface area. It is further desirable to be able to remove material that does not spall, with equipment that will also spall material that is spallable.

SUMMARY

A preferred embodiment of the invention is an apparatus for excavation of a borehole in a geological formation by spallation which is a rotating spallation head with circumferentially spaced jets. The apparatus comprises a rotationally stationary support connected to a jet housing that is rotatable thereto. The housing has a central axis and includes a plurality of jet nozzles, spaced circumferentially around the central axis, each arranged to emit a jet of hot fluid having a directional component that is radial with respect to the central axis and a directional component that is parallel to the central axis. The housing also includes at least one return passage therethrough for the passage of excavated material. The spallation apparatus further may include a plurality of cooling fluid conduits, each having an exit port adjacent the return passage and distributed throughout the jet housing. The apparatus also typically includes a heat generation chamber. Typically, there are two or more nozzles.

According to one preferred embodiment, the heat generation chamber is a combustion chamber, which may be energized by a spark. It may alternatively be an electric heating chamber, heated by an electric heating element that is energized by a turbogenerator, driven by a flow of water delivered to the turbogenerator from the surface in a conduit.

The jet housing may be rotated by an electric motor.

Another preferred embodiment is also an apparatus for the excavation of a borehole in a geological formation by spallation with wholly contained feed and return conduits. This apparatus comprises a spallation jet head a rotationally stationary feed conduit for feeding a working fluid from the surface of the geological formation to the spallation jet head; and a rotationally stationary return conduit for returning excavated material from the spallation jet head, to the surface of the geological formation. An air supply and a water supply may be connected to the feed conduit. For a low density embodiment, the mass ratio of water to air $M_{H_2O}/M_{air}$ is between 1 and 10. For a high density embodiment, $M_{H_2O}/M_{air}$ is between 50 and 200.

This embodiment may further comprise means for isolating the environment around the spallation jet head from the environment around the feed and return conduits. In addition, it may include connected to the feed conduit, a separator for separating air constituents of the working fluid from water constituents of the working fluid; and a fuel conduit connected between the surface of the geological formation to a fuel storage facility, which storage facility communicates with the jet head.

Because there are no rotating members connecting the surface and the downhole apparatus, a preferred embodiment may include, communicating between the surface of the geological formation and the spallation head, a cable for transmitting electromagnetic signals. The signals may be for controlling or monitoring a microprocessor from the surface, or for communicating with sensors and actuators, which may also communicate with the microprocessor.

Still another embodiment of the invention is a self supporting spallation excavation apparatus. It is for use in a borehole that is substantially filled with a fluid having a characteristic density. The apparatus comprises a spallation jet head and a rotationally stationary feed conduit for feeding a working fluid to the spallation jet head, communicating between the spallation jet head and the surface of the geological formation. At least one buoyant support is attached to the conduit so as to transmit buoyant stress to the conduit if the buoyant support contains a fluid having a characteristic density less than that of the fluid filling the borehole.

Yet another preferred embodiment is an apparatus for the continuous excavation of a borehole in a geological formation by spallation while new conduit is added to feed and/or return lines. The apparatus comprises a spallation jet head and a rotationally stationary feed conduit for feeding a working fluid to the spallation jet head, communicating between the spallation jet head and the surface of the geological formation, the feed conduit comprising a plurality of conduit sections connected end-to-end. A conduit length adding unit comprises a conduit entry port, a conduit exit port and a feed components inlet port. Also included is a feed supply unit that is connected to the feed components inlet port and that is also connected to a primary feed input unit having a fitting to connect with a new length of conduit and deliver feed components thereto from the feed supply unit.

This preferred embodiment may include a gate valve in the conduit length adding chamber that seals the inside of the conduit length adding chamber from the environment outside of the chamber if no conduit is engaged in the conduit entry port. The primary feed input unit is typically a power swivel. Also typically present is means to move the primary feed input unit, relative to the conduit adding chamber, between a first, conduit engaging position and a second, conduit disengaging position, the first position being spaced from the second position a distance greater than the length of a conduit section.

Yet another preferred embodiment of the invention is an apparatus for the continuous excavation of a borehole in a geological formation by spallation while new feed and/or conduit is being added having a downhole apparatus for accommodating relative motion. The apparatus comprises a spallation jet head and a conduit and a relative motion apparatus located downhole. The downhole apparatus has an input and an output, the input of which is connected to the conduit, the output of which is connected to the spallation jet head, the relative motion apparatus comprising means for allowing relative translational motion between the spallation jet head and the conduit and for allowing the flow of fluid from the conduit to the spallation jet head in during the relative motion.

Still another embodiment of the invention is an apparatus for excavation of a borehole in a geological formation by thermal processes that may include fusion and spallation. The apparatus comprises a rotationally stationary support and, connected to the support and rotatable with respect thereto, a jet housing having a central axis. The housing comprises a plurality of jet nozzles, spaced circumferentially around the central axis, each arranged to emit a jet of hot fluid having a directional component that is parallel to the central axis and at least one return passage therethrough for the passage of excavated material. The nozzles are arranged to provide a substantially uniform heat flux to the surface area being excavated, sufficient to fuse the geological material. The nozzles emit a flame jet. Typically, they are arranged along a spiral.

Another embodiment of the invention is a method for excavating a borehole in a geological formation using a rotating spallation head with a plurality of circumferentially located jet nozzles. The method comprises the steps of providing an apparatus, such as summarized above, into a pilot hole. A working fluid is provided to the jet housing through a conduit from the surface of the geological formation. The working fluid is heated to a temperature that will spall the rock formation and is emitted from the plurality of jet nozzles at an excavation site while rotating the jet housing relative to the rotationally stationary support and the pilot hole, thereby causing the geological formation to spall into chips. The spalled chips are removed from the excavation site through the return passage and a conduit to the surface of the geological formation and the jet housing is advanced deeper into the borehole being excavated.

Before introducing the apparatus into the hole, it may be filled with a fluid having a density of approximately that of water. The working fluid may be an air and water mixture, that is separated downhole into air and water constituents, the air being combusted with fuel, the water being used to cool and transport the spalls to the surface. The mass ratio of water to air $M_{H_2O}/M_{air}$ may be between 1 and 10 or between 50 and 200, depending on whether or not the borehole is filled with fluid.

Another preferred embodiment of the method of the invention is for providing spallation feed components to a spallation jet head that is continuously excavating a borehole in a geological formation, while adding new lengths of conduit. The method comprises the steps of providing flow of spallation feed components from a feed components supply unit to the spallation jet head through several elements. These elements include a primary feed input unit that is detachable from a newly added length of conduit and a newly added length of conduit (designated length "N") attached to the primary feed input unit at the conduit length's trailing end. The length N is engaged by a conduit adding chamber, which has a conduit input port, a conduit exit port and a spallation components inlet port. The feed components further are delivered through a length of conduit that has grown with the addition of new lengths of conduit, which is connected to the spallation jet head. The method further includes the step of causing the entire length of grown conduit, newly added length of conduit and detachable primary feed input unit to advance in the direction of borehole excavation while conducting the following steps. After the trailing end of the newly added length N of conduit has advanced into the conduit adding chamber beyond the conduit input port, providing flow of spallation feed components from the feed components supply unit to the conduit adding chamber through the spallation components inlet port, simultaneously with providing flow of spallation feed components from the feed components supply unit to the spallation jet head as set forth above. Next, the primary feed input unit is detached from the newly added length N of conduit, thereby opening the trailing end of the length N of conduit to the inside of the conduit adding chamber and the flow of spallation feed components from the spallation components inlet port. The primary feed input unit is detached and attached to the trailing end of a new added length of conduit (designated length "N+1") to the primary feed input unit. The leading end of the new added length N+1 of conduit is introduced into the conduit entry port of, the conduit adding chamber and engaged to the trailing end of the added length N of conduit. Flow of spallation feed components is provided from the feed components supply unit to the spallation jet head through the primary feed input unit, and the grown length of conduit, including the new lengths N and N+1, and the steps are repeated.

Still yet another preferred embodiment of the invention is an apparatus for the excavation of a borehole in a geological formation by spallation where air and water are delivered to the spallation apparatus mixed together. The apparatus comprises a spallation jet head, an air supply and a water supply. Connected to both the air and water supplies, is a rotationally stationary feed conduit for feeding a working fluid of combined air and water from the surface of the geological formation to the spallation jet head. The water to air ratio may be in either the high or low density ranges mentioned above, and typically, there is a downhole air/water separator.

A preferred embodiment of the invention is an apparatus for the excavation of a borehole in a geological formation by spallation that uses only electrokinetic energy from flowing water. It includes a spallation jet head, comprising at least one jet nozzle and an electric heat generation chamber. A water supply is connected to a rotationally stationary feed conduit for feeding a working fluid of water from the surface of the geological formation to the electric heat generation chamber of the spallation jet head. Typically, there is a turbogenerator, driven by the flow of water in the conduit, which energizes a heating element in the heating chamber.

The invention also includes an embodiment of a method for excavating a borehole in geological formation using fusion in the presence of water. A borehole is excavated and a thermal process apparatus capable of melting the geological formation is introduced into the hole. A working fluid is heated to a temperature sufficient to melt the geological formation and is jetted at the formation, in the presence of water, causing the rock to fuse. The fused material is removed from the excavation face through a return passage and a conduit by power of flowing water.

BRIEF DESCRIPTION OF THE DRAWINGS

These and other features, aspects, and advantages of the present invention will become better understood with regard to the following description, appended claims and accompanying drawings.

DETAILED DESCRIPTION

The invention includes several related embodiments of spallation apparati and methods, including a low density embodiment, and numerous high density embodiments.

In both the low and high density embodiments, spallation flame jets are configured in a novel fashion, to achieve maximum heat flux at the maximum diameter of the hole being formed, to efficiently remove rock by spallation.

With the low density embodiment, the hole surrounding the apparatus is essentially empty. Further, with the low density embodiment, the mass ratio of water to air, $M_{H_2O}/M_{air} \cong 2$ (between 1 and 10), while for the high density embodiment specifically discussed below, $M_{H_2O}/M_{air} \cong 100$ (between 50 and 200), an increase of about fifty. In the high density embodiments, the hole surrounding the apparatus is also filled with a high density fluid that, among other things, helps to prevent the hole from collapsing due to stresses caused by surrounding rock formations.

Figure 9:
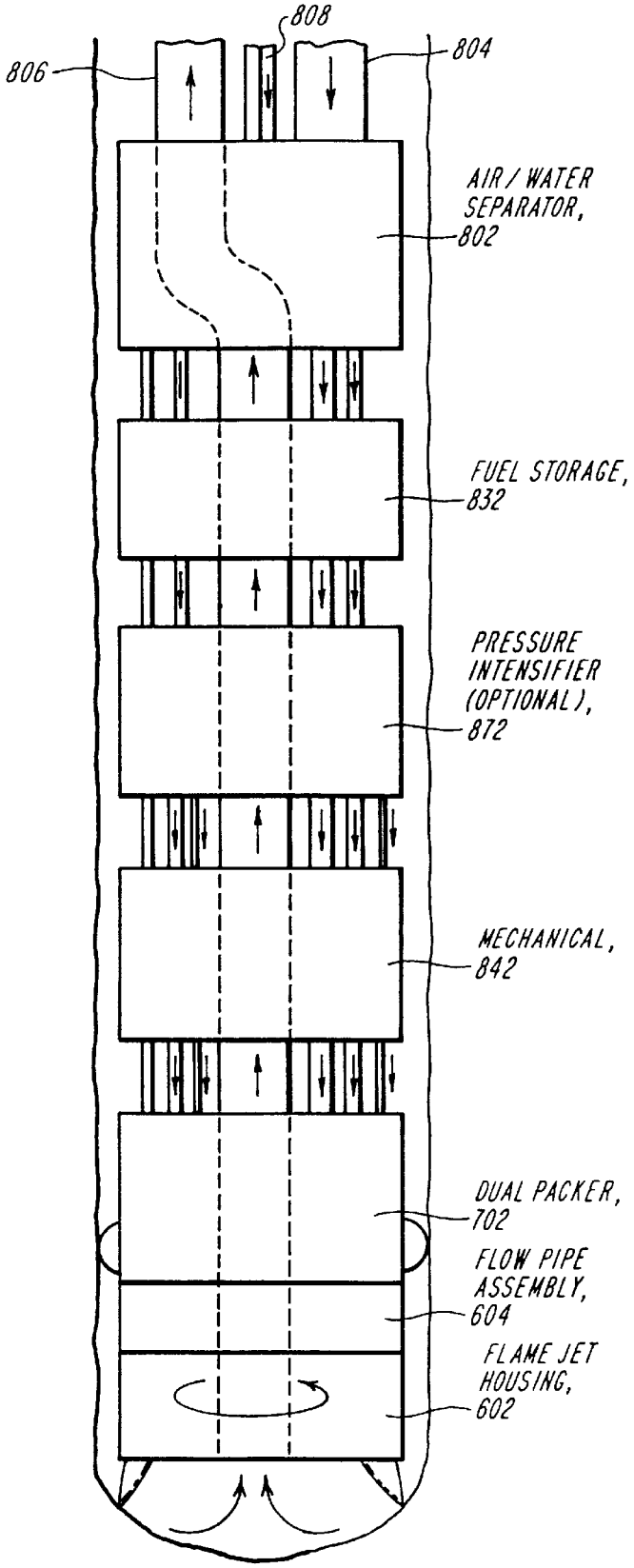
FIG. 9 is a schematic representation in block diagram form, of a flame jet head and other auxiliary down-hole components for both the low and high density embodiments of the invention.

To provide an overview of the apparatus, the basic components of an advancing spallation apparatus of the invention are shown schematically in FIG. 9. A flame jet housing 602 is suspended from a flow pipe assembly 604 (both shown in more detail in FIGS. 6, 6A, and 6B). The flame jet housing 602 delivers the flame jets that cause the spallation to the rock face. The flow pipe assembly 604 is rotationally stationary, and the flame jet housing 602 rotates, while being suspended from the flow pipe assembly 604.

A dual packer unit 702 (shown in more detail in FIG. 7) is above the flow pipe assembly, and isolates the environment below it from that above. Its dual packers proceed downward in inch-worm fashion to constantly maintain the environmental separation. Upstream of the dual packer unit is a mechanical systems unit 842 (shown in more detail in FIG. 8A), which may house a turbo generator, and other mechanical apparatus. An optional pressure intensifier 872 (shown in more detail in FIG. 20) may be upstream of the mechanical unit 842. Further upstream still is a fuel storage unit 832 and an air/water separator 802 (all shown in more detail in FIG. 8A).

All of the foregoing is at the bottom of the shaft being made. A pair of pipes 806 and 804 connect the downhole units shown in FIG. 9 to the surface, along with an armored conduit 808. (The pipes that connect between the surface and the down-hole equipment are designated in the drawings by two different numeral sets, as follows. The feed pipe for the water and the air, when considered near to the surface, is designated as 1004. Similarly, the return pipe, near to the surface, is designated 1006 and the fuel and communications conduit is designated 1011. The corresponding pipes that are connected to the down-hole equipment are referred to as 804 for the air and water feed, 806 for the return and 808 for the fuel and communications conduit. The reason for the different numerals, is to accommodate the possibility of intervening equipment (such as the differential motion housing illustrated in FIG. 4) which would necessitate a change in piping.) In the low density embodiment, the annulus of the shaft between the pipes 804 and 806, and the wellbore face, is "empty" or filled with air and perhaps combustion products. For the high density mode, this space (from the surface to the dual packer unit 702) is filled with a higher density fluid, such as water.

Figure 3:
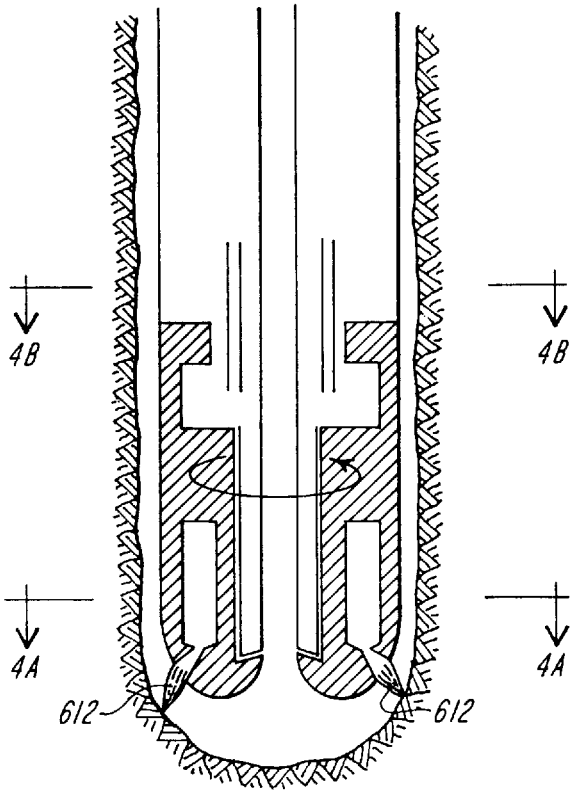
FIG. 3 is a schematic representation in elevational cross-section of the flame jet head of a spallation apparatus of a preferred embodiment of the invention, having a pair of canted, off-axis jets, installed in a borehole.

FIG. 3 illustrates schematically a significant difference between the prior art embodiment (FIG. 1) and the several expressions of the preferred embodiment that will be discussed. The products of thermal combustion are jetted downwards from several nozzles 612 located near the outer circumference of the bottom of the drilling device instead of the single centrally located jet 116 employed in the prior art. In addition, the structure holding the nozzles 612 is rotated about the central axis, thereby producing a form of an annular jet. This configuration produces significant advantages over the prior art method.

In practice, the low density embodiment entails the injection of compressed air containing sufficient entrained water to provide both adequate cooling of the down-hole equipment and quenching of the mixture of spalls and combustion gases to safe temperature levels. The pressure of the compressed air can range from ~150 psi (~10 bars) for shallow hole drilling to greater than 1500 psi (~100 bars) for deeper drilling. The density of the compressed air ranges from ~0.001 gm/cm$^3$ to ~0.02 gm/cm$^3$ in these two examples. The cooling water transported by the air doubles the effective density of the mixtures.

AIR AND WATER DELIVERY

A typical feature of both high and low density embodiments is the delivery system for the gaseous oxidants and cooling liquid. Air, pure or enriched in oxygen, is mixed with a cooling fluid, typically water, to form a two-phase (gas and liquid), two-component mixture. The mixture is fed from the surface to a down-hole site relatively near to the working flame jets. At the down-hole site, the two components are separated from each other in an expansion chamber. Fuel, typically a liquid hydrocarbon, is also transported to the same down-hole site via another passage.

A preferred embodiment uses the hollow drill string apparatus found on all oil and gas drilling rigs. A preferred embodiment for the fuel transport uses a flexible armored conduit containing a passageway. In addition, this armored conduit can also contain wires or optical fibers for information transfer. Alternatively, fuel can be delivered in another drill string, similar in connections to the air/water drill string, but smaller in diameter.

It is also possible to deliver the combustion and cooling components separately or in a different combination, using additional tubing, conduits, or multichambered pipe.

Fuel may be transported as a third component in the gas/liquid mixture, but its intimate proximity to the compressed oxygen component of the gas makes safe separation of the gas phase from the fuel/water mixture difficult.

Of critical importance to using thermal spallation, either in the low or high density embodiments, are the means by which the working fluids are delivered to the down-hole spallation "machine" 501 and the means by which the altered fluids and their spall burden are recovered. FIGS. 5A–F illustrate schematically the respective conduit 502 and its fluid components, flow direction for each fluid state with relation to the spalling "machine" 501 and the use of other mechanisms for further flow control.

Figure 5A:
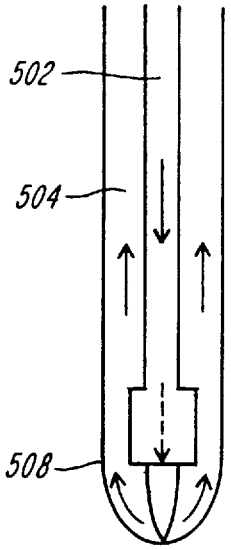
FIG. 5A (PRIOR ART)
FIGS. 5A–F show schematically some of the possible flow modes useful in thermal spallation drilling.

FIG. 5A shows the "conventional" flow mode employed in both conventional rotary drilling and the prior art in thermal spallation drilling. In the case of thermal spallation drilling, the working fluids are delivered through a central conduit 502 and the fluids and spall burden are recovered through the annulus 504 surrounding the conduit 502.

Figure 5B:
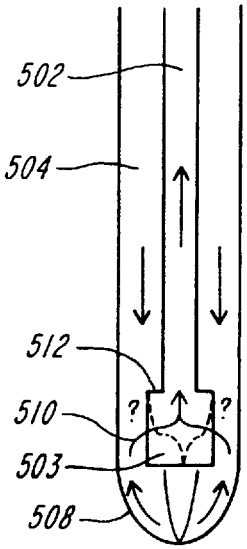

FIG. 5B reverses the flow direction with the drilling products "reversed" out the supporting central drill string conduit 502. A similar arrangement, with a surface sliding seal packer, is used to rotary drill large diameter holes by conventional means. This arrangement will not work with multi jet rotating head spallation without further down-hole modifications due to the inability to force all of the down coming water/air mixture through the required portions of the spallation "machine."

Figure 5C:
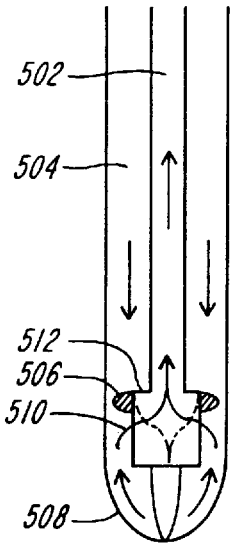

FIG. 5C provides one such modification. A packer seal 506 isolates the spall working region 508 and ports 510 connected to the "reversed" flow passage in the drill pipe. The down coming fluid enters the "machine" above the packer through ports 512. A dual packer assembly that will provide continuous sealing for a constantly moving "machine" is described below.

Figure 5D:
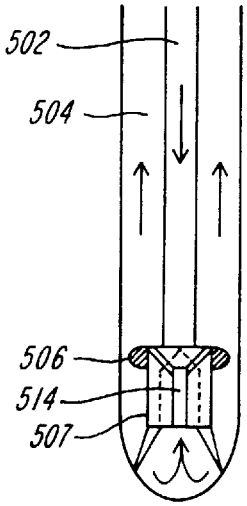
Figure 5E:
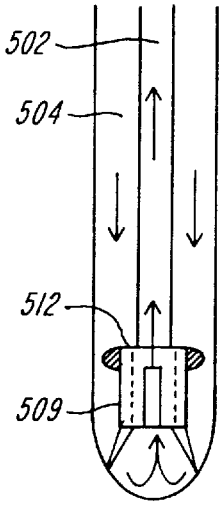

FIGS. 5D, E illustrate the use of a multi jet spallation "machine." These embodiments use axial flow return passages 514 in the "machines" 507, 509. The use of the dual packer allows either the conventional (FIG. 5D) or reverse flow modes (FIG. 5E).

For all of the embodiments illustrated in FIGS. 5A–5E, almost all of the borehole wall is exposed either to the injected pressurized air-bearing water or the returning water return flow that is highly charged (with $N_2$ and $CO_2$). Possible deleterious effects could result from this exposure. Certainly, uncontrolled losses of water/gases from the annular space surrounding the drill pipe(s) into the rock formation can affect control of the drilling process.

A better method is to isolate the wellbore from either situation. This allows both control of water transport across the wellbore surface (either positive or negative) and control of the chemistry of the annular fluid—most important if the borehole wall encompasses sedimentary sections.

Of much greater concern regarding the mechanics of drilling are two problems that are related to the diameter of the borehole being drilled and the flow area of the drill string. In the conventional flow models (FIGS. 5A and 5D), great care must be taken to provide sufficient upward fluid velocity in the annulus, to transport the spalls. This requires an adequate injection flow. In the reverse flow modes (FIGS. 5B, 5C, and 5E) the annulus area is almost always considerably greater than the flow area of the drill string and this results in relatively low downward fluid velocity. Studies indicate that transport of air by water in down flowing vertical passages is made more chaotic and irregular with reduction in the fluid velocity (O. Shoham, "Flow pattern transition and characterization in gas-liquid two phase flow in inclined pipes," Ph. D. thesis, Tel-Aviv University, 1982). It is important that the fluid flow be more regular, rather than less so that it can be understood, predicted and controlled.

Figure 5F:
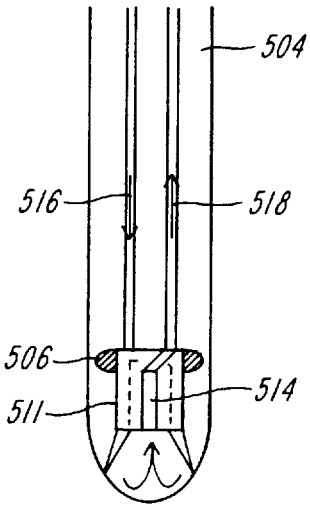

As shown in FIG. 5F, complete isolation of the entire drilled borehole wall through the use of both dual packers and dual drill strings 516, 518 overcomes almost all of the problems stated above. This technology has been employed (but rarely) in conventional rotary drilling. Although there is an obvious financial burden resulting from the cost of a second string and more complex handling equipment, the significant improvement in system control and elimination of borehole wall induced problems will greatly increase the probability of achieving "linear" drilling costs with its tremendous economic advantages.

In all of the following descriptions, both the low and high density embodiments, a suitable mode of support and delivery of the several fluid components is, as shown in FIG. 5F, the dual pipe mode. However, other modes are possible, with the consequent issues of concern identified above.

A preferred embodiment of the invention, useful for both low and high density flame jet spallation is shown schematically with reference to FIGS. 6, 6A, 6B, and 6C.

FLAME JET HOUSING

Figure 6:
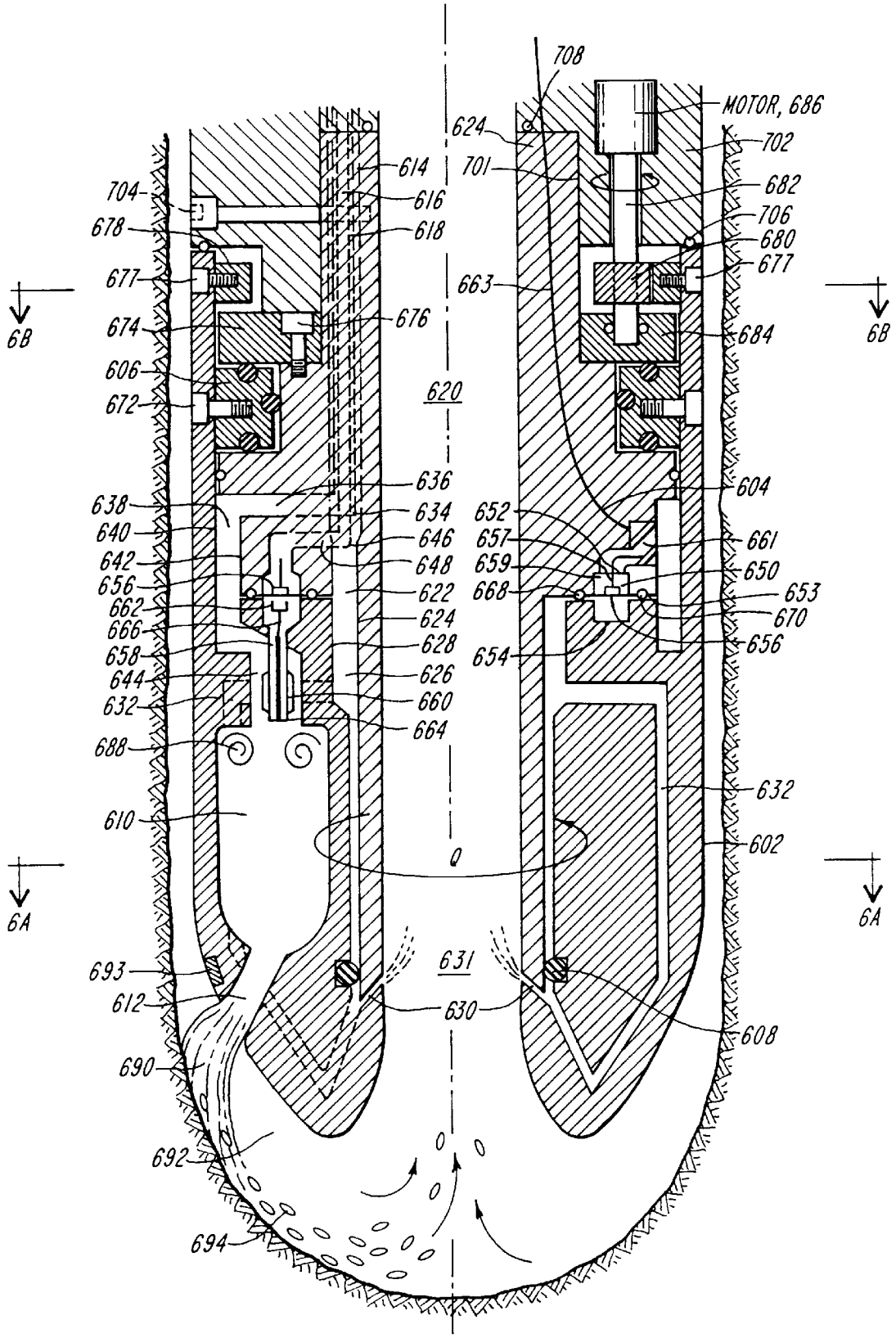
FIG. 6 is a schematic representation in elevational cross-section of the flame jet head of a spallation apparatus, such as shown in FIG. 3, in more detail.

A flame jet housing 602 is rotatably mounted to a centrally located flow pipe assembly support 604 and supported by bearing assemblies 606 and 608. The jet housing 602 contains two or more generally elongated combustion chambers 610 (one of which is shown in FIG. 6, but three are visible in FIG. 6A), with their long axes parallel to the central axis of the flow pipe assembly 604. The combustion chambers 610 are connected to the atmosphere outside of the jet housing through three nozzles 612. The combustion chambers 610 are typically arranged symmetrically around the central axis of the flowpipe assembly 604.

The flowpipe assembly 604 serves several purposes. It acts as the bearing for the rotating jet housing 602. It contains within it passage-ways 614 for the cooling water, 616 for the fuel, and 618 for the combustion air. It also contains a central conduit 620 for the escaping combustion gases and returning rock spalls.

The cooling water is delivered from an air/water separator 802 (FIGS. 8A and 9) through passageway 614 to a water distribution point 622 where it enters an annular channel 626 formed by the outer surface 624 of the tubular portion 624 of the flow pipe assembly 604 and an inner surface 628 of the flame jet housing 602. A portion of the water travels downwards through the channel 626 to an inward facing cooling water exit 630. This exit 630 is an upward facing gap between the flame jet housing 602 and the flow pipe assembly 604. The cooling water jets upwards and toward the central axis of the flow pipe assembly 604, mixing with the hot combustion gases 690 and rock spalls 694 in region 631.

Figure 6A:
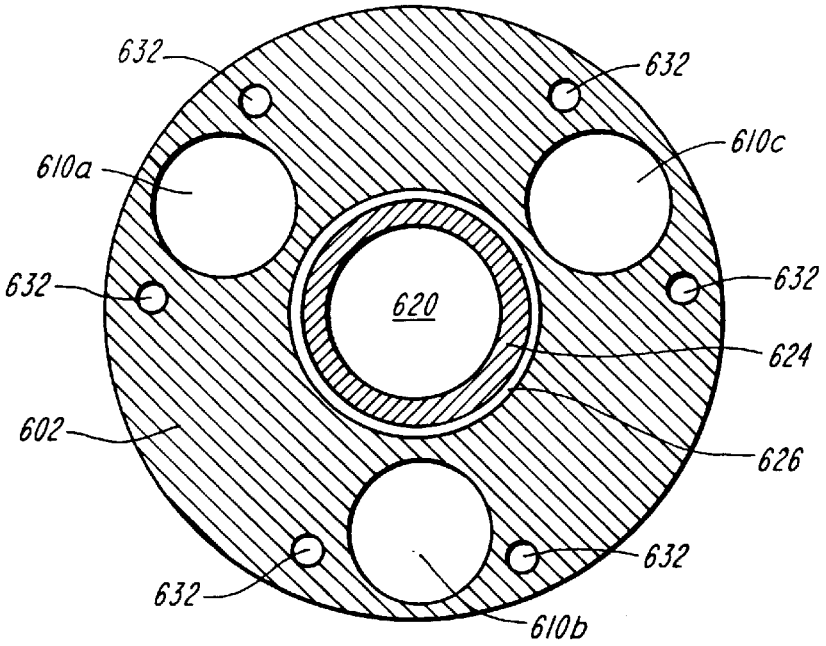
FIG. 6A is a plan cross-sectional representation of the embodiment of the invention shown in FIG. 6 along lines 6A—6A.
Figure 6B:
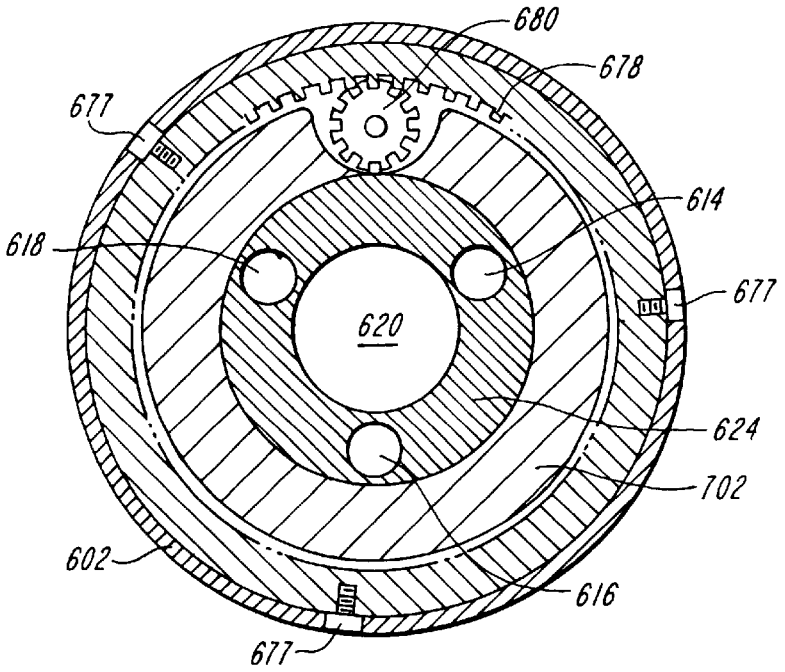
FIG. 6B is a plan cross-sectional representation of the embodiment of the invention shown in FIG. 6 along lines 6B—6B.
Figure 6C:
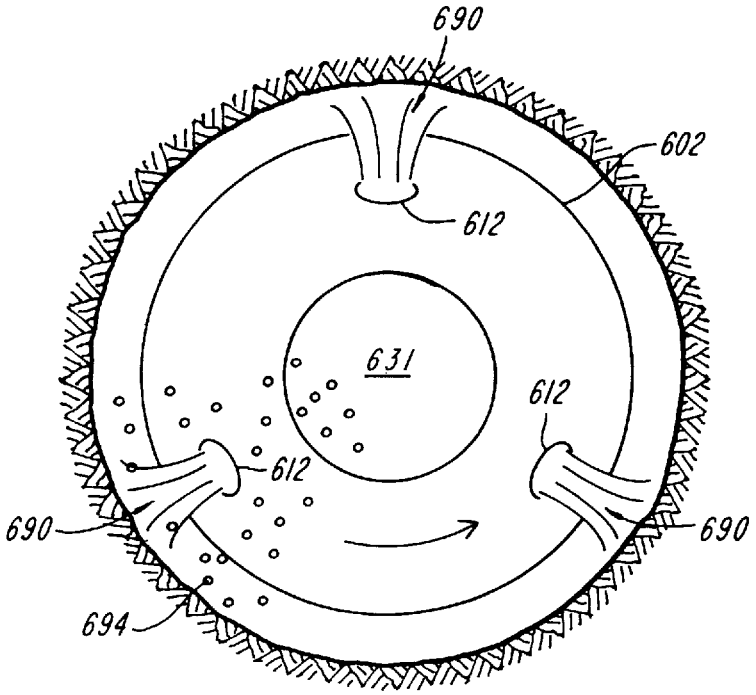
FIG. 6C shows schematically a flame jet housing, with three exiting flame jets, in outline only.

The remainder of the water passes through numerous tubular passageways 632 which pierce the jet housing (of which two are shown in FIG. 6, and six are shown in FIG. 6A). The number, size, and location of these tubular passageways 632 are determined to provide adequate heat removal. The terminus of these conduits 632 is at the cooling water exit 630.

The combustion air, in a like fashion, is delivered from the air/water separator 802 through passageway 618 to air distribution point 634. It then is conducted through a radial conduit 636 radially outward meeting the annular channel (or plenum) 638 formed by the rotating inner wall 640 of the jet housing 602 and the stationary (relative to rotation) outer wall 642 of the flow pipe assembly 604. From the annular plenum 638, the combustion air is conducted into the mixing region 644 located at the entrance to each combustion chamber 610.

The fuel is likewise transported from the fuel storage tank 832 (FIG. 8) through passageway 616 to fuel distribution point 646. It then moves radially outward through conduit 648, meeting the fuel delivery plenum 650. The plenum 650 is formed by the meeting of two annular channels 652 and 654. The upper channel 652, located in the stationary (relative to rotation) flow pipe assembly 604, serves two purposes: to transport the fuel to the lower channel 654; and to house an insulated metal ring 656 which, at appropriate times, is charged to high voltage through an insulated cable 657 led through a passageway 659 from the high voltage output of a transformer 661 mounted in the flow pipe assembly 604. A low voltage cable 663 passes from the transformer 661, through the body of the flow pipe assembly 604, the body of the dual packer assembly 702, and finally to the generator 860 (FIG. 8A) mounted in the mechanical section 842.

The lower channel located in the rotating jet housing likewise has two purposes: to efficiently carry fuel to the conduits 658, which connect to the fuel atomizing chambers 660 located at the entrance to each combustion chamber 610; and to house a spring loaded conductive roller 662, which maintains electrical contact with the metal ring 656. The roller 662 connects to a spark gap 664 at the bottom of the fuel atomizing chamber 660 through an insulated cable 666. The interface gap 653 between the flow pipe assembly 604 and the flame jet housing 602 also communicates both with the air plenum 638, and the water channel 628 and with the fuel delivery plenum 650. To prevent mixing of these three fluid components, two O-rings 668 and 670 are placed in the flow pipe assembly 604.

The two bearing assemblies 606 and 608 are designed to allow rotation of the jet housing 602 in the presence of either upwards or downwards net thrust. The bearing holding structure 606 is fastened to the jet housing assembly 602 with bolts 672. The thrust surface for the upper bearings of the bearing holding structure 606 is provided by disc 674 which is fastened to the flow pipe assembly 604 with bolts 676.

The thrust of the jets may provide the rotational force to rotate the flame jet housing. However, due to a lack of easy control of rotational rate, an electric motor drive 686 coupled through a gear 678 (FIGS. 6 and 6B) fastened to the flame jet housing 602 with bolts 677 is preferred. A ring gear 678 with inward facing teeth is driven by a driving gear 680, mounted on a drive shaft 682. The drive shaft 682 is bottom supported by bearings 684. The shaft is directly connected to a variable speed motor 686 mounted in the dual packer assembly 702.

In both the low and high density embodiments, a spark gap assembly as described above may be provided for initial ignition of the combustible mixture. Ignition may be provided by other means, such as catalytic surfaces, electrically heated probes, etc. In the high density embodiment, self ignition may be present. After ignition a stable, self-circulating region of flame can be maintained by proper design, in the "flame-holder" region 688.

The liquid fuel and combustion air mix in the combustion chambers 610 and are ignited to generate jets 690 of very hot fluid that exit the combustion chambers through the nozzles 612 between the combustion chambers 610 and the environment outside of the flame jet housing 602.

The nozzles 612 are aimed generally away from the end of the jet housing 602 that connects to the flowpipe assembly 604 (i.e. are aimed generally downward in normal operation), and generally perpendicular to a radius from the central axis. This is shown schematically in FIG. 6C, which shows the outline of the jet housing 602 and three flame jets 690. Rather than being perfectly perpendicular to a radius, there may be a slight radially outward cant to the alignment of the nozzles 612. Thus, when jets of combusted fuel and air escape from the combustion chambers 610 into the lower pressure region 692 outside the housing 602, the motor driven rotation of the housing causes each jet to move in a downward spiral resulting from the steady downward drilling motion. The pitch of this spiral depends on both the rotational rate and the drilling velocity and is expected to be small, resulting in a close approximation to a circle for each revolution. Consequently, the tips of each flame jet travels around the rock surface substantially in a circle with the result that all points on the "circle" experience higher heat fluxes periodically, as the flame jets approach, impinge and recede from the respective points.

The jets may be of the cavitating type.

The downward and rotation motion of the jets and their locations sets the diameter of the region of maximum needed spallation and consequently the final diameter of the spalled hole. That portion of the cross-sectional area of the hole to be drilled having the greatest area lies at the perimeter of the hole—that area which is impinged by the cone of the jet, the region of highest heat transfer. This embodiment of the invention provides essentially the opposite of that of the conventional prior art thermal spallation technology; i.e., maximum heat transfer in the region with the largest cross sectional area.

The downward spiraling jet-streams move in coiled paths close to the spalling rock surface converging towards the center of the hole. It is this convergence and accompanying increased mass flow density that maintains a high heat transfer in regions of small hole radius—again an opposite effect from that of conventional spallation. There the gas flow from the impacting central jet moves in a divergent fashion radially outwards and upwards with rapidly decreasing mass flow density resulting in continually lessened heat transfer rates. The result is greater efficiency, producing greater drilling velocities and/or reduced fuel and compressed air requirements.

The rock face is spalled such that small chips 694 of rock are removed from the rock surfaces. The high velocity hot combustion products lift the spalled rock pieces away from the spalling front and up to the region Q where cooling water exiting from channels 630 quench the pieces and cool the combustion products. From here, as shown in FIG. 9, the rock pieces are lifted by the combined flow in turn into the flow pipe assembly 604, the dual packer section 702, the mechanical features housing 842 the fuel storage section 832, the separator housing 802 and finally through the return pipe 806 to the surface apparatus.

DUAL ISOLATION PACKER

Figure 1:
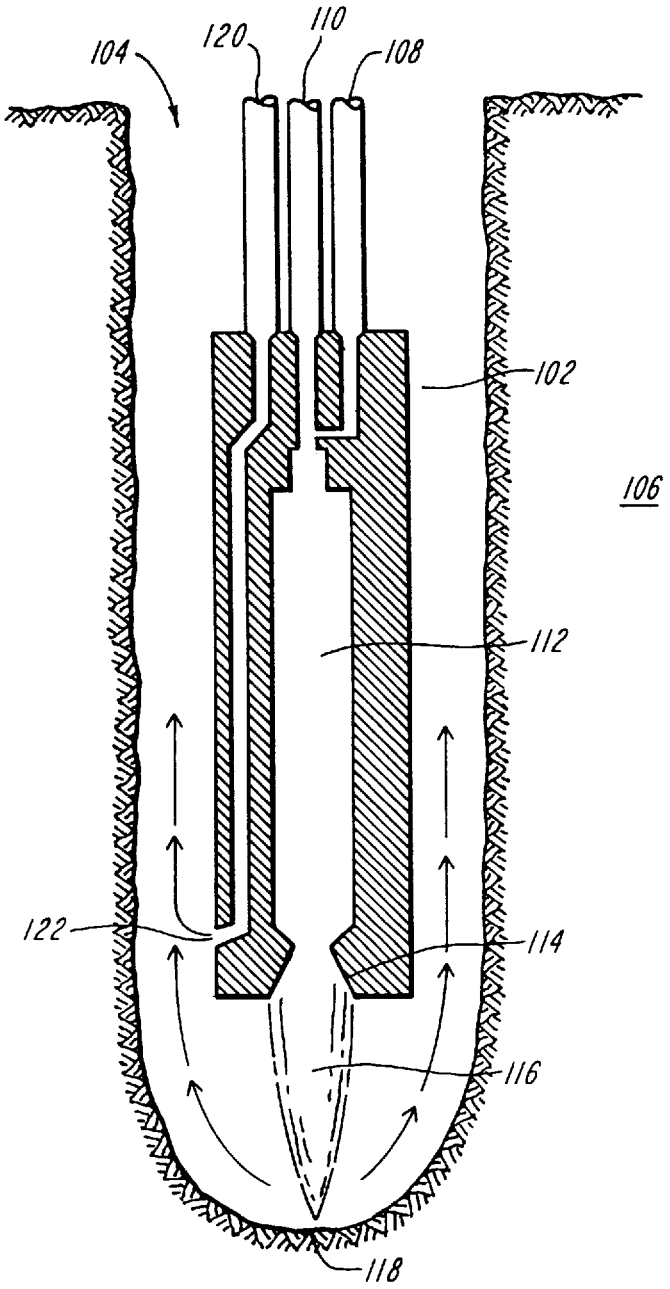
FIG. 1 (PRIOR ART)
FIG. 1 is a schematic representation in elevational cross-section of the flame jet head of a spallation apparatus of the prior art.

The flow mode of spallation apparatus employing the prior art is straightforward as shown in FIG. 1. The flow is annular at all depths in the borehole being formed. However, in the apparatus of the present invention, described in FIG. 6, uncertainties arise concerning flow of the combustion products and spalls. The strong jet action and large central aperture will favor movement of these products up the central flow pipe assembly passage 620. Potential downward flow in the annulus would greatly complicate analysis of the total spalling process.

Figure 7:
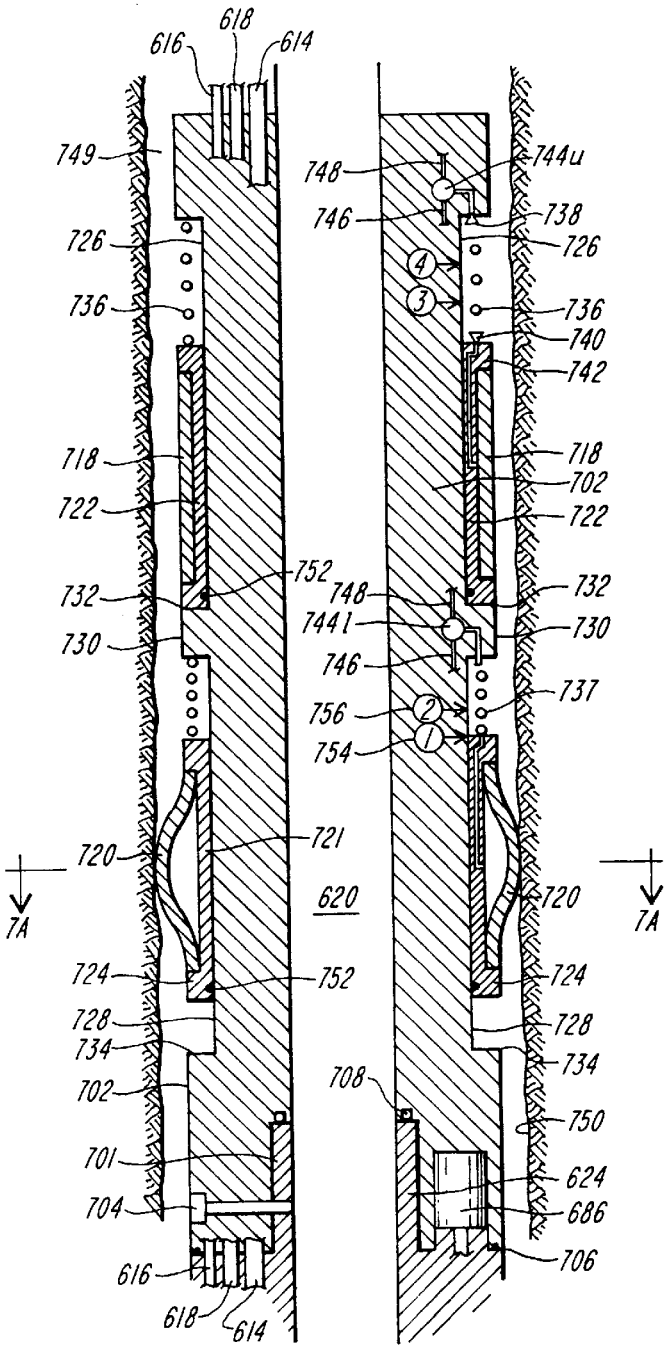
FIG. 7 is a schematic representation in elevational cross-section of the dual packer fluid isolation apparatus.

To prevent such uncontrolled downward flow, and also to provide both centralization and elimination of lateral apparatus oscillation, the tubular portion 624 of the flow pipe assembly 604 is inserted into the bottom recess 701 of a dual isolation packer section 702 (FIG. 7). A series of bolts 704 secure this juncture. O-rings 706 and 708 insure flow integrity for the several flow channels 614 (water), 618 (air), 616 (fuel) (shown in part) and 620 (combustion products and spalls).

Figure 7B:
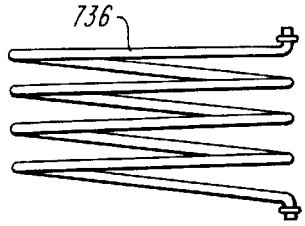
FIG. 7B is a schematic representation of the hollow tubing portion of the dual packer isolation apparatus shown in FIG. 7.

Two inflatable packers 718 and 720 are mounted on sleeves 722 and 724. These sleeves slide on recessed sections in the outer surface of the dual isolation packer section 702. The two recessed sections 726 and 728 are separated from each other by full diameter section 730 of the surface. The bottom end of each recessed section 732 and 734 acts as a stop for each sliding sleeve. In FIG. 7 the upper sleeve 722 is resting against lower stop 732. In the uninflated mode (packer 718) the sleeve 722 is held against the stop 732 by a spring 736 in its expanded mode (shown in a side elevation view, without the central pipe, in FIG. 7B). The spring is constructed of hollow tubing using metal with good spring characteristics. The diameter loosely fits the diameter of the recess 726. The ends of the spring are connected into right angle fixtures having two vertical male screw connections facing up and down respectively. These screw connections fit into female screw connections at the top of the recess and the top of the sleeve respectively 738, 740. An interior passageway in the sleeve connects the passageway 742 in the hollow spring to the inside of the inflatable packer 718. Another passageway within the body of the dual packer section 702 further connects the top of the hollow spring 736 to an upper three-way valve 744*u*. The other connections to the valve 744*u* are to a regulated compressed air source 748 and to the annulus 749 above the two packers. The other connections to the valve 744*u* are line 748 which connects to a regulated compressed air supply 749 (for packer inflation) and line 746 which connects to the annulus 747 (for packer deflation). A line 751 connects the compressed air regulator 749 to the compressed air supply line 618.

The packers achieve steady state control in the following manner. The lower packer 720 is inflated, contacting the borehole wall 750, while the dual packer section slides downwards through the sleeve 721. An O-ring 752 prevents leakage beneath the sleeve 721. In this mode it provides isolation to the annular region below the packer 720. As the dual packer section (and the rest of the apparatus above and below it to which it is attached) continues downward (further compressing the spring 737) the sensor 754 senses the approach of the stationary sleeve, and triggers (by electronic device) a change in the status of the upper valve 744*u* from vent to compressed air. This results in inflation of the upper packer 718, resulting in it remaining stationary in the borehole, while the dual packer assembly 702 continues downward. For a time, there is redundant isolation. The lower packer 720 in the meantime also remains stationary while the dual packer assembly 702 continues downward. Eventually, sensor 756 comes alongside the top of the packer and is activated. Its activation causes the lower valve 7441, similarly connected to compressed air and a vent, to switch from air to vent resulting in packer deflation. The lower spring 737 forces the lower sleeve 721 to its rest position awaiting a triggering signal from the upper packer 718 assembly. The packers thus move inch-worm fashion down the hole, while the pipe advances inside the packers. Thus, there is no period in which there is fluid communication past the dual isolation packer section.

The pressure at the working face can be underbalanced relative to the pore pressure in the rock to facilitate separation of the spalls from the rock.

Figure 7A:
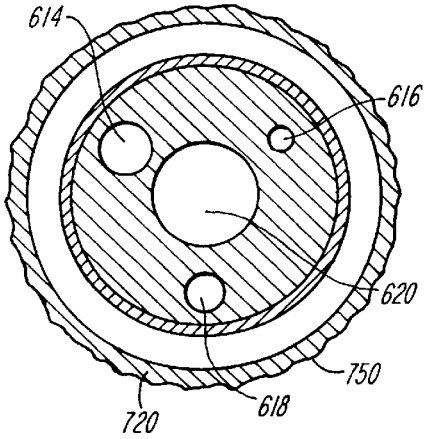
FIG. 7A is a plan cross-sectional representation of the embodiments of the invention shown in FIG. 7 along lines 7A—7A.

FIG. 7A shows the location of the three conduits for water 614, air 618, and fuel 616 as being essentially adjacent. This is possible, however it is shown this way only for simplifying the drawings. A more preferred arrangement is shown in the plan cross-sectional view of FIG. 7A, where the three conduits are spread out, essentially equidistantly, around the circumference of the dual packer assembly 702. This is desirable so that when the three conduits enter the flow pipe assembly 604, there is room for all of the various paths and hardware.

Figures 8A, 8B:
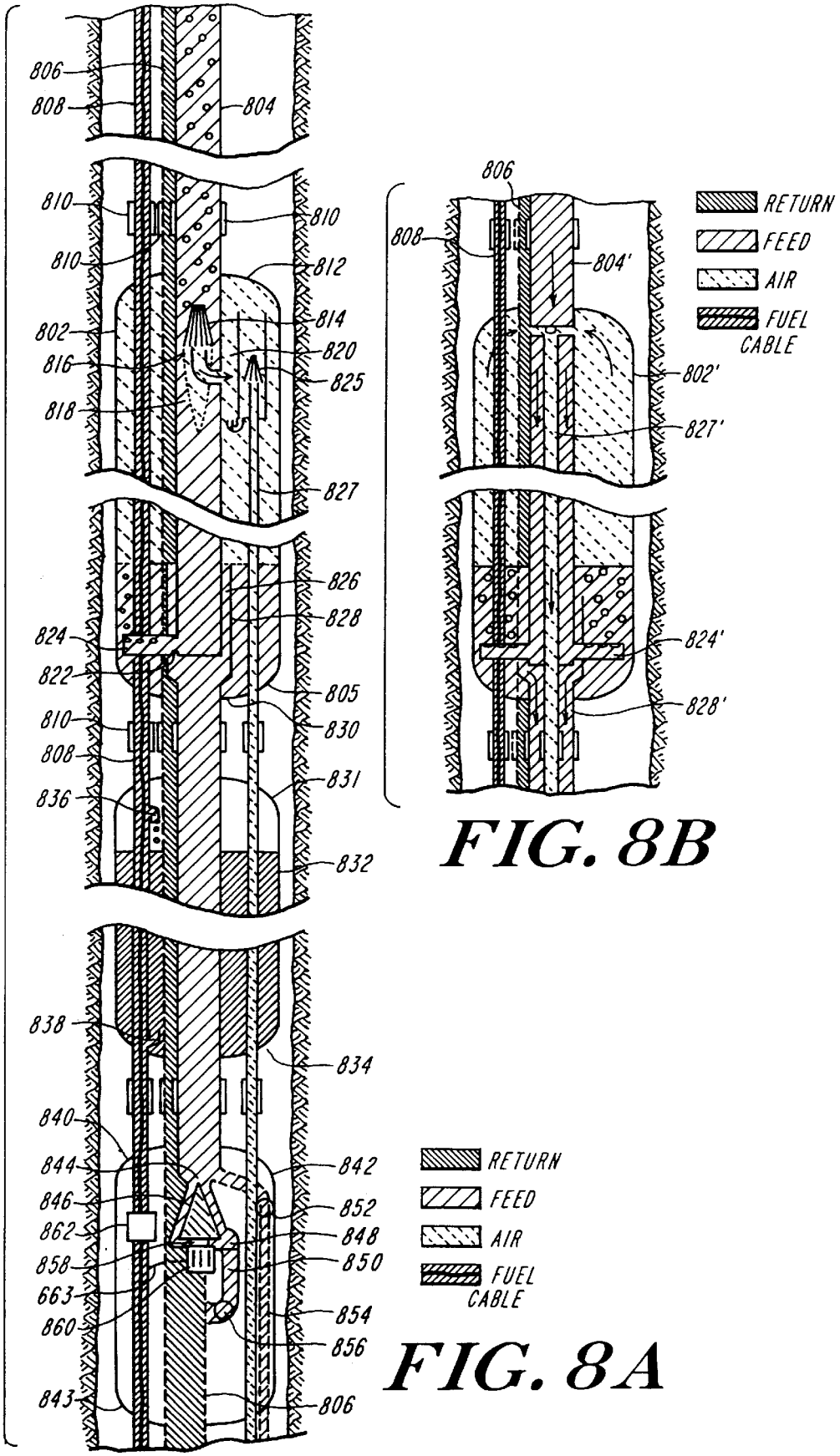
FIG. 8A is a schematic representation in elevational cross-section of the air/water separator, fuel storage and mechanical housings.
FIG. 8B is a schematic representation in elevational cross-section of another embodiment of an air/water separator unit.

A preferred embodiment of the portion of the apparatus of the invention intermediate the ground surface and the dual packer assembly 702 is shown schematically in FIGS. 8A and 8B, FIG. 8B showing an alternate embodiment. This embodiment has the twin concentric drill pipe option shown in FIG. 5F. The feed pipe 804 carries the combustion air down as bubbles in a stream of pressurized water. (This pipe is designated 1004 in FIGS. 10A, 10B, 10C.)

Figure 12A:
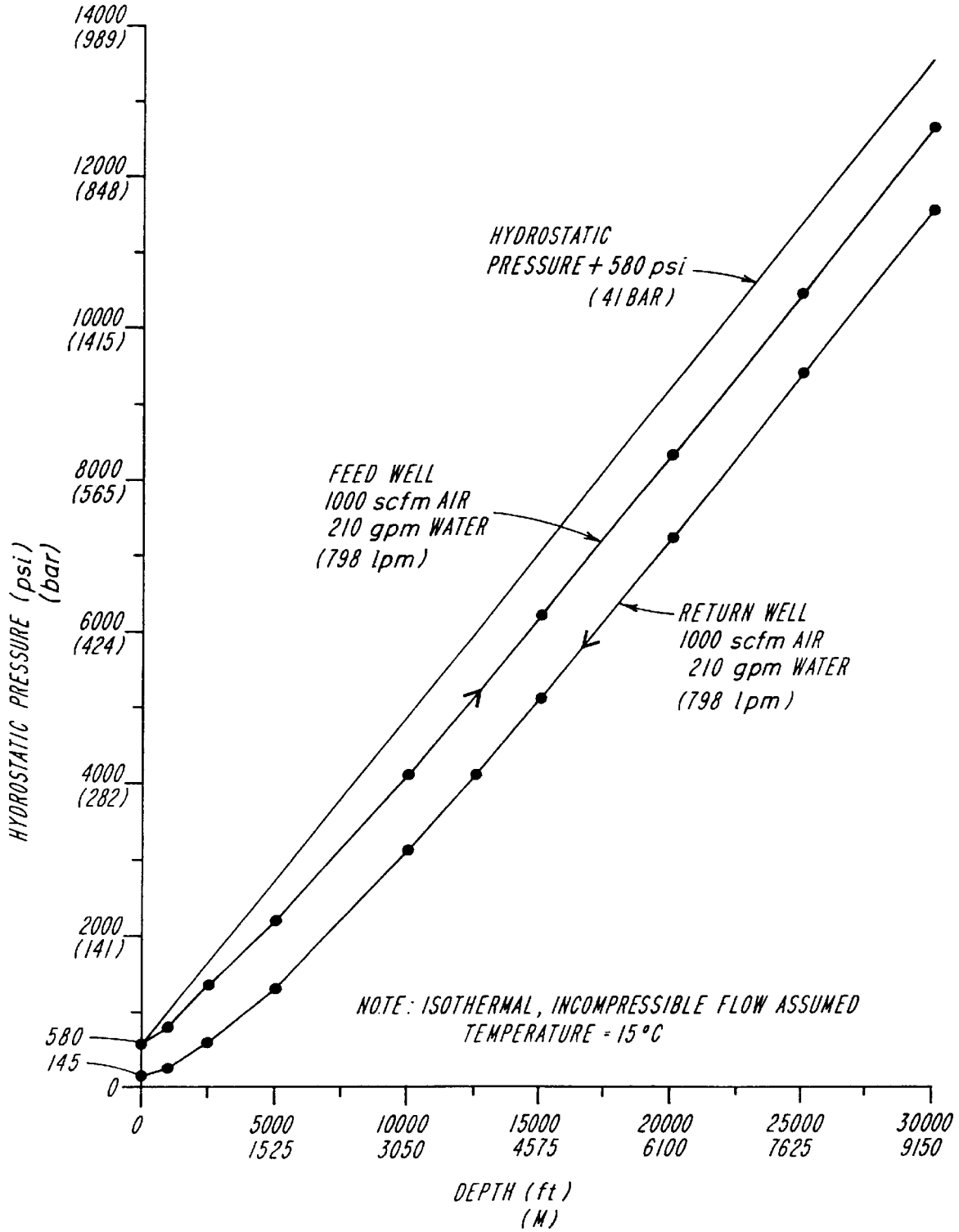
FIGS. 12A, B, and C are graphical representations showing the local hydrostatic pressures with depth for the air/water mixture and fuel. Also shown is the void fraction (gas fraction) with depth.
Figure 12B:
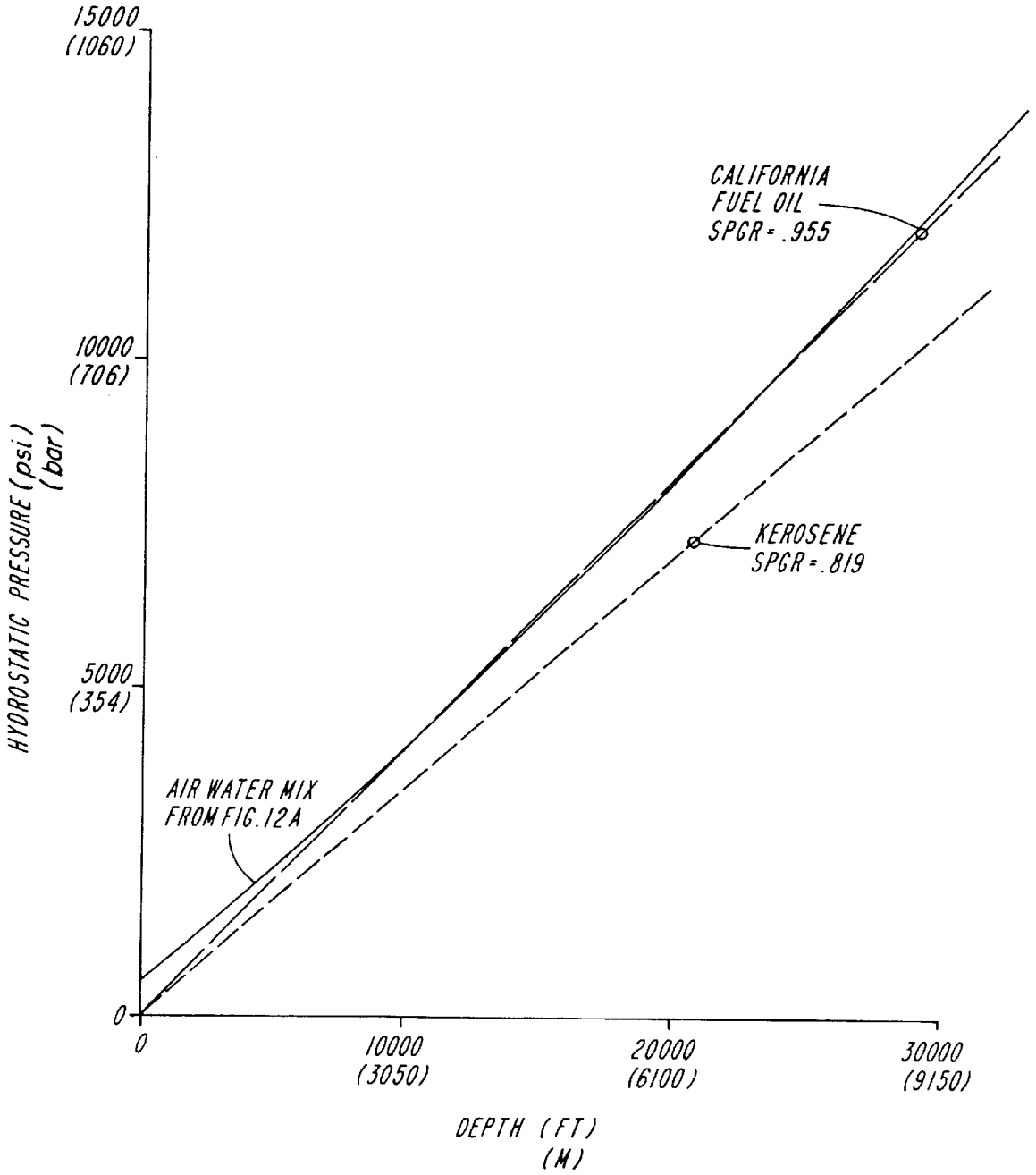
Figure 12C:
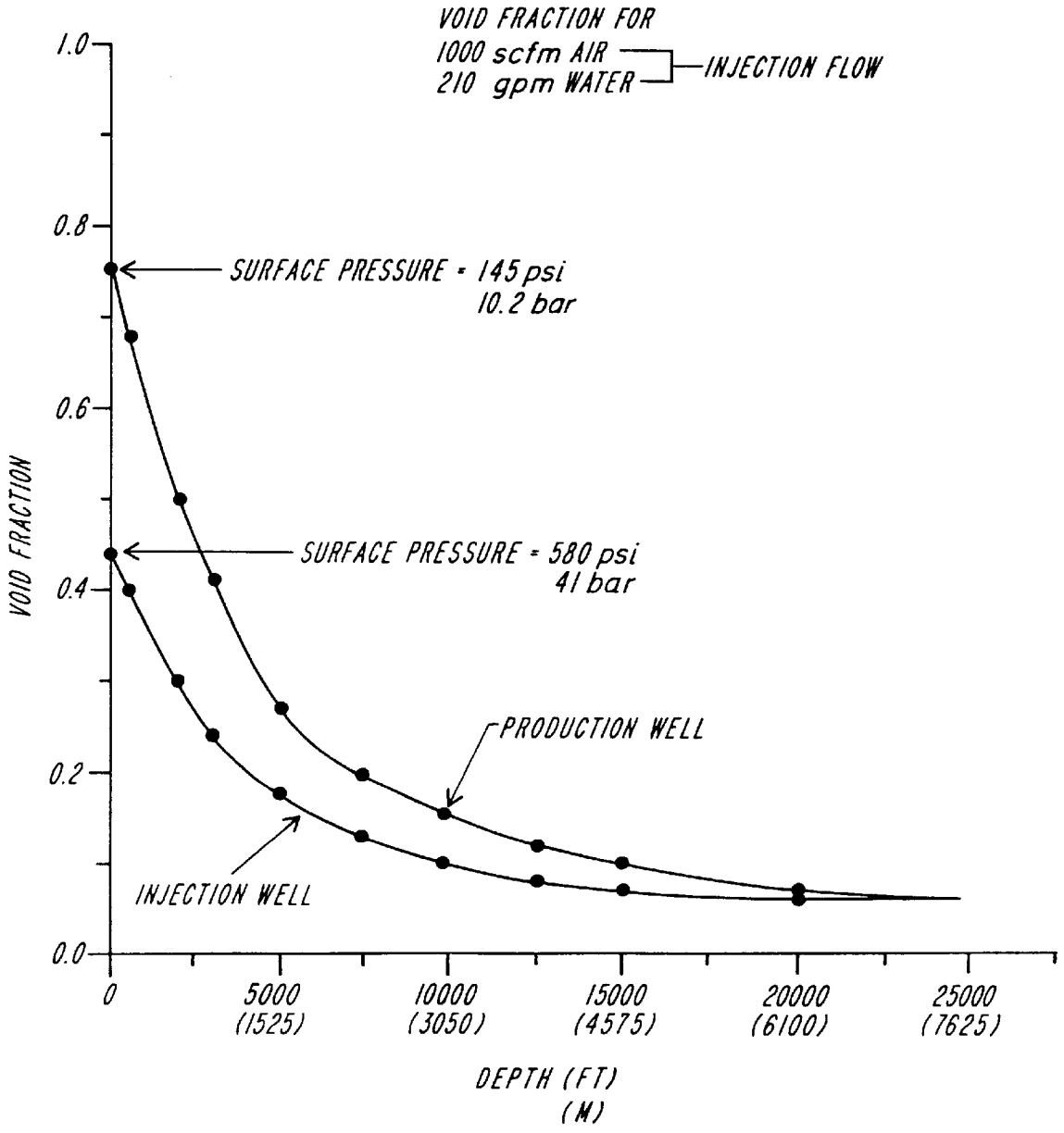

FIGS. 12A and 12C show the local pressure with depth for both the feed (injection) and return (production) flow along with void (gas) fraction for a typical air/water input. (The arrows indicate the direction of flow of material over time.) The difference in pressure between the two wells at equal depths remains relatively constant over most of the depth range and provides the jet driving force. In FIGS. 12A and 12C, the unit SCFM=standard cubic feet/min which is equal to 0.0283 $m^3$/min. The example shown would result in a thermal energy release of ~1.8 MW if a stoichiometric amount of fuel (~46 gal/hr of kerosene (175 l/hr)) were combusted with separated air. FIG. 12B shows the unpressurized "hydrostat" for both kerosene and California fuel oil and the very desirable matching of pressure with depth between the fuel oil and air/water mixture.

The several utility pipes 804, 806, and 808 are connected by couplings 810 to the top cap 812 of an air/water separator housing 802. Interior to the separator housing, the water feed pipe 804 contains a conical fixture 814 with its apex facing upwards. The outer surface of this cone is shaped so that the impinging air/water mixture is forced to rotate and swirl downwards. This results in the mixture moving in annular flow below the bottom 816 of the cone 814. The majority of the air moves into a cavity 818 and is drawn into the surrounding separator housing cavity 820 which is maintained at a slightly lower pressure than that of the air/water mixture just upstream of the conical separator 814. The remaining, air-depleted, water moves downward in the feed pipe 804 passing through a hydraulic impedance 822, which lowers its pressure to that of the separator housing cavity 820. The water is then fed into a perforated feed pipe 824 and allowed to flow upwards into the cavity. During this upward flow, its velocity is substantially reduced, which allows the remaining air contained in bubbles to escape into the air storage cavity 820. (Some air remains in solution). Several conical screens 821 trap any entrained water. The separated air passes through a second stage separator 825, and is carried downward in passage 827.

The water then flows over and into the annulus 826 formed by the feed pipe 804 and a surrounding, descending tube 828. This tube 828 continues downward as the separated water feed through the bottom 830 of the separator housing. The other utilities, spall return, 806, and fuel line, 808 pass directly through the separator housing.

FIG. 8B shows an alternate (and simpler) design for the air/water separator. The air/water mixture is allowed to flow upwards in the chamber 8021. The much less dense air phase separates upwards.

Additional couplings 810 join the several utility pipes and conduit 827, 828, 806, and 808 exiting the bottom 830 of the separator housing 802, to companion pipes and conduit which pass through the top 831 of the fuel storage housing 832 and exit through the fuel storage housing bottom 834. Fuel exits from a port 836 in the fuel conduit 808 and is temporarily stored. Because of the lower density of the fuel (e.g., kerosene has 0.819 spec. grav. at 1 atm) an additional pressure head is applied at the surface to the fuel. If more dense California fuel oil (specific gravity ≈0.955) is used, its "hydrostat" is almost an exact match to that of the chosen air/water mixture. For safety purposes, it is beneficial that the fuel entry pressure be greater than that of the combustion air at the mixing chamber to prevent flash back. An electric fuel pump (not shown) can supply the additional pressure head for the fuel oil, reducing the need for surface pressurization.

The fuel passage in the conduit terminates below the port 836 and is re-established at the entry port 838. There is no fluid passageway between these two points. This conduit and the other separated fluid pipes exit the bottom of the fuel storage housing 832 and are connected by couplings with companion pipes which enter the top 840 of the mechanical features housing 842. The spall return pipe 806, and the separated air pipe 827 pass through this mechanical housing 842 and exit through the bottom 843 of the mechanical housing. The water is fed into the input 844 of a hydraulic turbine 846, and exits from the output 848 at lower pressure to a manifold 850. Valve 852 controls the flow of water 854 used in cooling the flame jet head 602. Valve 856 vents the remaining water into the return pipe 806 for additional lift.

The turbine shaft 858, drives an electrical generator 860 whose electrical output is used for, among other things, powering the rotation of the flame jet head 602 and generating the ignition spark. In addition, the mechanical housing 842 contains the microprocessors 862 that control the various system processes, such as the motor 686 that rotates the spallation head.

The final major function between housings connects the mechanical features housing 842 with the dual packer section 702 /flow pipe assembly 604 /flame jet housing 602 composite package with couplings joining companion tubes, and electrical and processor leads. This is shown generally in FIG. 9.

The apparatus shown in FIG. 6 avoids the problem of rock overheating in general, and particularly at any convective heat transfer singularities, because not all of the heat flux is delivered through a single axial jet aimed at the same general point. Thus, the parameters of heat flux delivery can be adjusted so that the minimum heat flux that is required to spall the rock is delivered where it is needed. Such spallation is termed "onset spallation" because heating beyond that required for the onset of spallation is not pursued. Any further heating only tends to weaken the rock and inhibit spallation. Further, because the heat flux is applied to any given locus of rock periodically, it is easier to maintain the rock to be spalled at or below the brittle-to-ductile transformation temperature. Thus, it is easier to maintain spallation and prevent generating molten rock, with all of the attendant difficulties mentioned above.

A controlled delivery of the exiting cooling water may also be directed to further cool the periodically heated rock surfaces, if the type of material being spalled has a low brittle-to-ductile transformation temperature. This could be accomplished by diverting some of the cooling water present in passages in the flame jet housing through small jet openings (nozzles) spaced between the flame jet nozzles and having the same attitude (target).

Figure 10A:
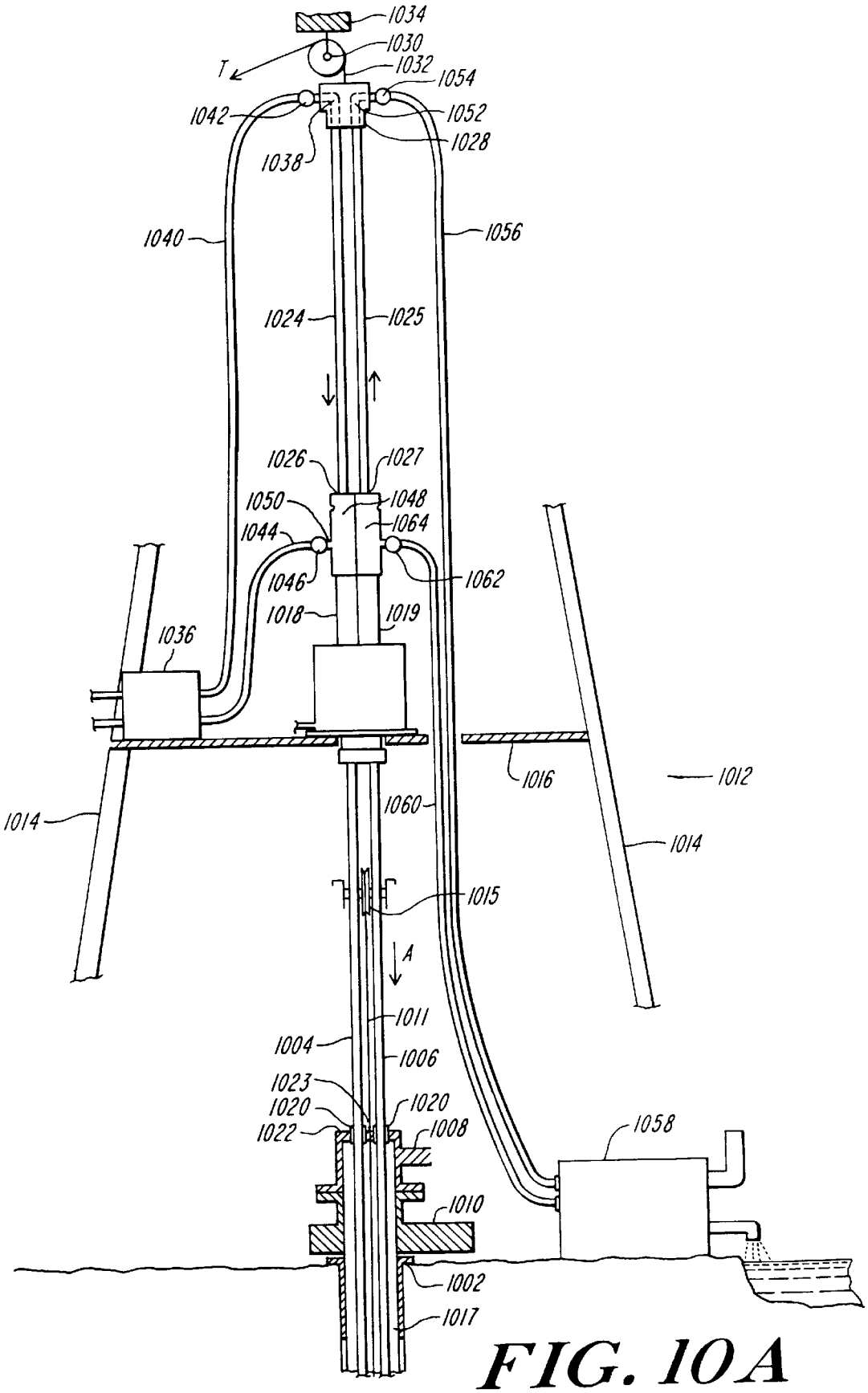
FIG. 10A is a schematic representation in elevational cross-section of equipment located at the well head to be used in conjunction with a spallation hole-forming flame jet apparatus.

As shown in FIGS. 9 and 10A, an armored conduit 808 (1011 FIG. 10A) is located central to the two pipes 804, 806 (1004, 1006 FIG. 10A) of the dual pipe assembly. This armored conduit is used for several purposes. Included among these purposes are to provide one of the three components of the combustion and cooling components, typically the fuel. Another purpose is to provide a conduit for communication cables, or another communication network between the surface and the various down-hole components. Such an arrangement is possible with the spallation apparatus, because the major portion of the underground piping does not rotate and hangs vertically. Therefore, the conduit may be located in the inside space between the dual piping structure without risk of destruction or damage due to abrasion, and without the difficulties attendant communicating between a stationary unit and a rotating unit. Such communication facilitates monitoring down-hole conditions, controlling down-hole activities, and controlling such activities in light of such conditions.

Typical instrumentation for diagnostic purposes include, but are not limited to, instrumentation to monitor: fuel/air transport rates; standoff distance; penetration rate of the flame jet housing into the rock formation; rotational rate of the flame jet housing; spall lifting capacity of the combustion products plus vaporized cooling water; flame temperature, such as thermocouple 693 (FIG. 6); combustion chamber pressure; spallation zone pressure; cooled gas temperature and velocity, caliper, real time video observation of the borehole wall, and with suitable cooling protection, the spalling cavity itself, hole orientation and inclination and borehole wall properties derived from suitable logging tools.

Thus, the novel combustion product separation apparatus allows the use of conventional drill pipe for most of the length of the pipe required for very deep holes.

Conventional coil tubing, either nested or single channel, may be used as the feed piping 1004, and return piping 1006 (FIG. 10A).

ADDING NEW PIPE LENGTHS

In the following description of the continuous drilling mechanism, the preferred embodiment will be the dual, parallel string flow mode as shown in FIG. 5F.

A novel aspect of the apparatus of the invention, which facilitates continuous drilling, is the mechanism by which new lengths of feed 1004 and return 1006 pipe (FIG. 10A)

(also referred to herein as "conduit") are added. This is shown schematically with reference to FIGS. 10A–10D, and 11A–11F. An object of the invention is to avoid delay in rock removal necessitated by adding new lengths of feed pipe. Such delays contribute significantly to the length of time that it takes to excavate a hole. In many cases, it is beneficial to sacrifice some speed in the removal of rock at the interface to achieve shorter periods of no rock removal at all. It is also beneficial to avoid removing substantial lengths of piping that have already been lowered and then relowering the same lengths. In addition, by enabling continuous steady state drilling, one avoids the need to first circulate out the spalls being transported to the surface, depressurize the wellbore, add the stand of drill pipe, re-pressurize and re-stabilize flow. The apparatus shown in FIGS. 10A–10D, and 11A–F, coupled with the flame jet spallation apparatus discussed above, eliminates these costly delays.

The hole is capped by a conventional well head 1002. The well head supports the feed 1004 and return 1006 pipes, which are typically advanced into the borehole along the direction indicated by the arrow "A". A borehole outlet port 1008 is provided, through which the fluid contained in the borehole annulus 1017 (in the high density mode) is monitored and controlled if necessary. Conventional rams 1010 are provided for conventional safety purposes. A conventional drilling rig 1012 having supports 1014 and a floor 1016 supports the well head apparatus. Sliding seals 1020 in the well head cap 1022 provide control of any annulus flow or pressure.

Pressurized dual pipe (or conduit) adding chambers 1018, 1019 provide an environment for support of the dual downhole pipes 1004, 1006 and for the simultaneous joining of new lengths of dual pipe 1024, 1025 to the dual pipe strings already in place. New dual pipe 1024, 1025 (feed and return, respectively) enters the pressurized pipe adding chamber 1018, 1019 through pressurizable pipe entry seals 1026, 1027 of the pneumatic slip seal type. The new dual pipes are supported by a detachable, primary feed input unit, such as a dual power swivel 1028. The power swivel 1028 is supported by a pulley 1030 and cable 1032. The pulley is fixed to a support 1034 that is fixed relative to the drilling rig 1012. Tension is applied to the cable 1032 in the direction of the arrow T. An armored conduit 1011 (FIGS. 10A–10D) containing instrument cables and/or optical fibers and a fuel transport passageway feeds from a reel 1013 over a sheave 1015, entering the borehole 1017 through a sliding seal 1023.

A feed supply unit 1036 (suitably supported to a fixed support) is connected to the feed pipe input 1038 of the power swivel 1028 through a primary hose 1040 and isolation valve 1042. The supply unit 1036 is also connected through another, alternative hose 1044 and isolation valve 1046, to the pressurized pipe adding chamber 1018 through a spallation components inlet port 1050.

The output or return flow, consisting of water, combustion products, spalls, mud, etc., passes through the return pipe 1006 up to the return flow output passage 1052 in the dual power swivel 1028. It exits from the swivel 1028 through an isolation valve 1054 to a primary return hose 1056 to the conventional product handling and recirculation apparatus 1058. The product handling apparatus 1058 is also connected through another, alternative hose 1060 through an isolation valve 1062 to the pressurized return pipe adding chamber 1019.

Figure 10B:
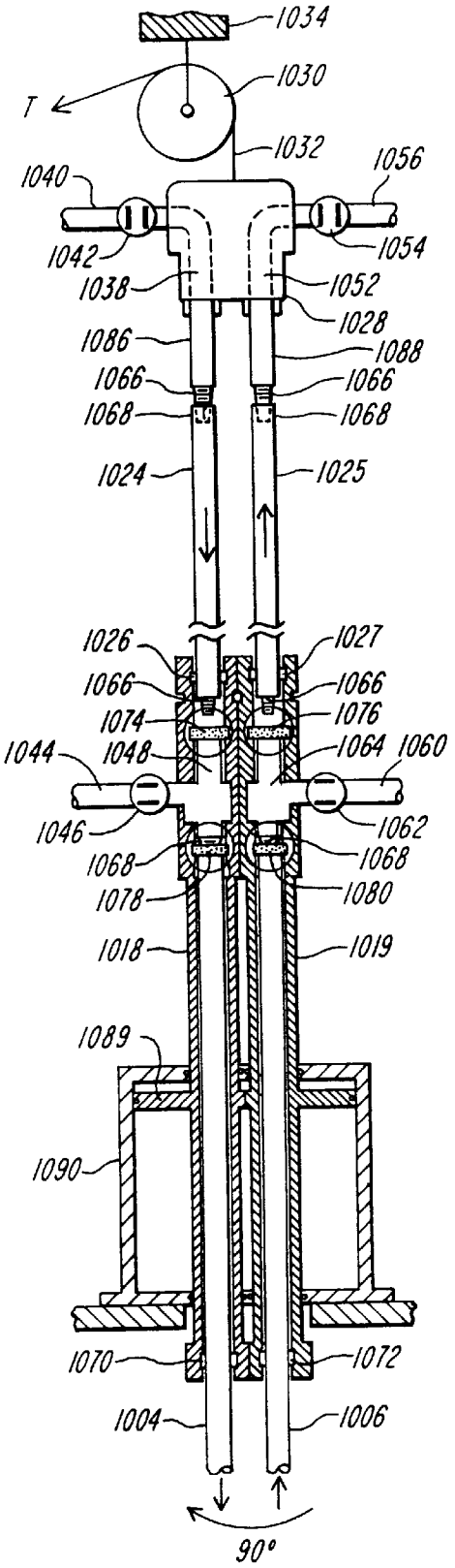
FIG. 10B is an enlarged view also in elevational cross-section of the upper portion of the above surface equipment show in FIG. 10A.
Figure 10C:
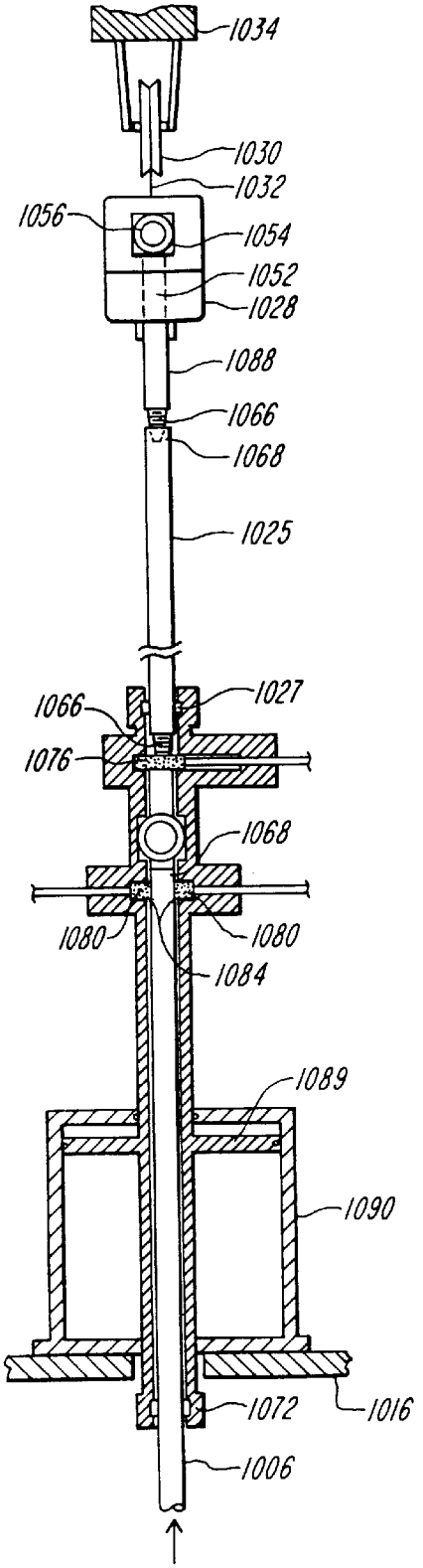
FIG. 10C shows the apparatus shown in FIG. 10B, rotated 90°.
Figure 10D:
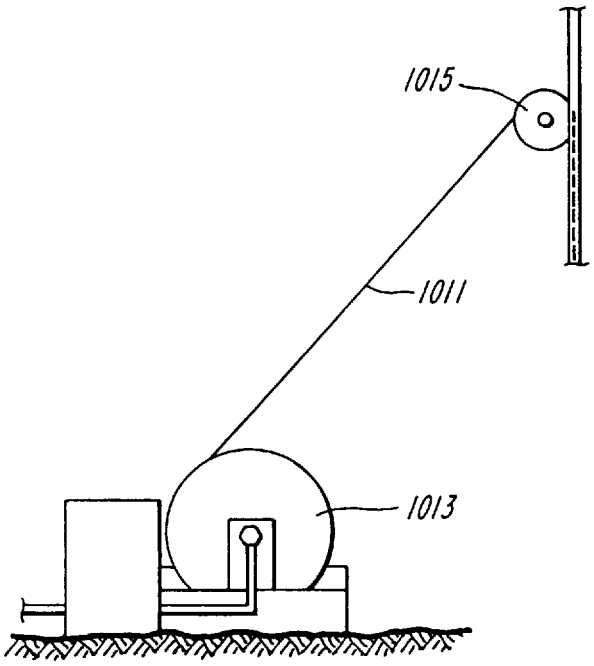
FIG. 10D shows the portion of the apparatus of FIG. 10A for adding new fuel conduit, rotated 90°.

Some portions of the pressurized chamber are shown in more detail in FIGS. 10B and 10C (FIG. 10C is FIG. 10B rotated 90° clockwise, as viewed from above). Each length of new dual pipe 1024, 1025 is threaded at each end. As shown, the length of pipe being added has male threads 1066 at its leading end and female threads 1068 shown schematically at its trailing end. Similarly, the length of dual pipe already engaged with the already linked-up dual piping 1004, 1006 also has female threads 1068 at its trailing end. Typically, each pipe section is about thirty ft. (10 meters) long. (Sections of up to ninety ft. (30 meters) can be handled if the rig height allows.)

The inside of the pressurized pipe adding chambers 1018, 1019 are pressurized above ambient (however at different pressures). Thus, all of the seals must be suitable to maintain these pressures. The pipe entry seals 1026, 1027 seal at the point where lengths of new dual pipe 1024, 1025 are introduced into their respective pressurized pipe adding chambers 1018, 1019. Pipe exit seals 1070, 1072 (also pneumatic slip type seals) seal at the point where the growing length of dual pipes 1004, 1006 already engaged exit the pressurized pipe adding chamber 1018, 1019. Gate valves 1074, 1076 seal the inside of the pipe adding chambers 1018, 1019 from the ambient atmosphere at those times when there is no pipe engaged in the pipe entry seals 1026, 1027. A typical length for the pipe adding chambers is on the order of ten ft. (three meters) between the entry seals 1026, 1027 and the exit seals 1070, 1072.

The normal sequence for the addition of new pipe, is as follows, shown in part with reference to FIGS. 11A–11F. For most of the time, the new dual pipes 1024, 1025 are threaded into the already connected string of piping 1004, 1006, and the weight of the entire string is supported by the cable 1032 and the pulley 1030. The mixture of cooling water and air is provided in a two phase, two component mixture to the length of new feed pipe 1024 from the supply 1036 through the primary supply hose 1040 and the power swivel 1028. A return flow exits from the top of the length of new return pipe 1025 to the product handling apparatus 1058 through the power swivel 1028 and the primary return hose 1056.

The following description focuses on the feed pipe 1004, as shown in FIGS. 11A–11F. The operation is similar with respect to return pipe 1006. The entire pipe assembly steadily advances downward into the hole. Eventually, the trailing edges of the new pipe 1024 enters the pressurized pipe adding chamber 1018 through the pipe entry seal 1026.

Figure 11C:
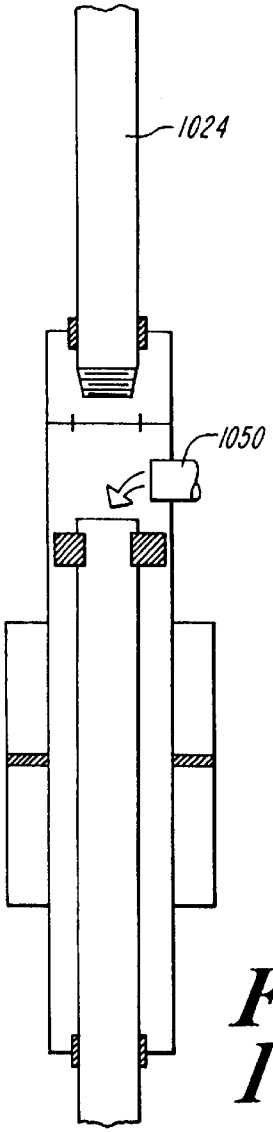
FIGS. 11A, B, C, D, E, and F are schematic representations of different phases of the hydraulic support mechanism show in FIG. 10B.
Figure 11B:
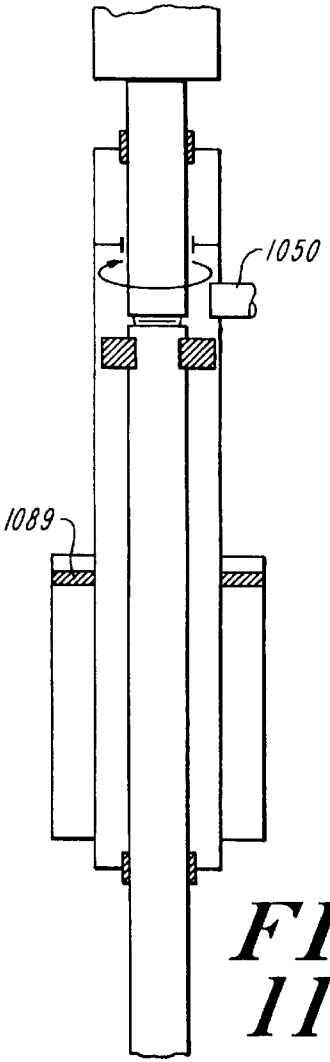
Figure 11A:
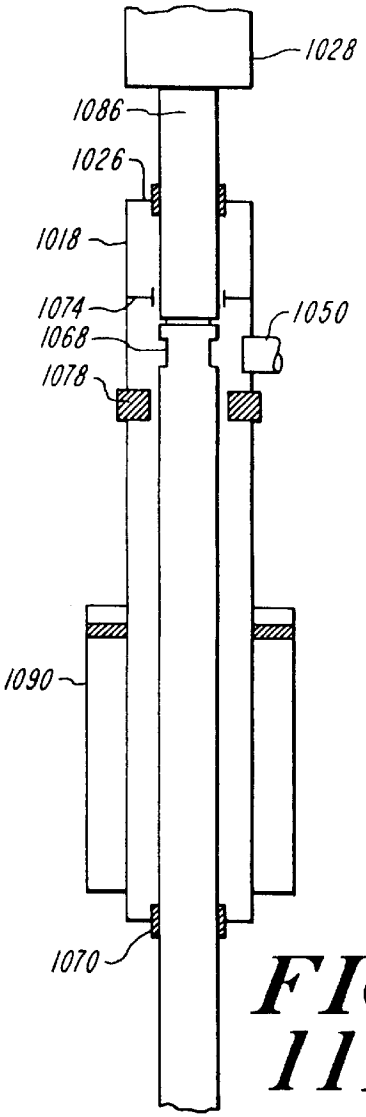

Once the trailing edge is inside the chamber 1018, (and downstream of the gate valve 1074, shown in FIG. 11C), the dogs 1078 engage a detent 1068 near the trailing edge of the pipe (shown in FIG. 11B). Upon engagement of the dogs, the hydraulic piston 1089 (which support the dogs 1078) automatically starts downward, matching its velocity with that of the support cable. (According to one embodiment (not shown), sensors determine the pipe position and this information is fed to the microprocessor. It coordinates the engagement of the dogs and piston movement.) The swivel head stub 1086 is unthreaded from the trailing edges of the pipe, leaving the pipe supported by the dogs 1078 and the piston 1089 of the hydraulic lowering device 1090. The trailing pipe end is open inside the pressurizable chamber 1018.

Figure 11F:
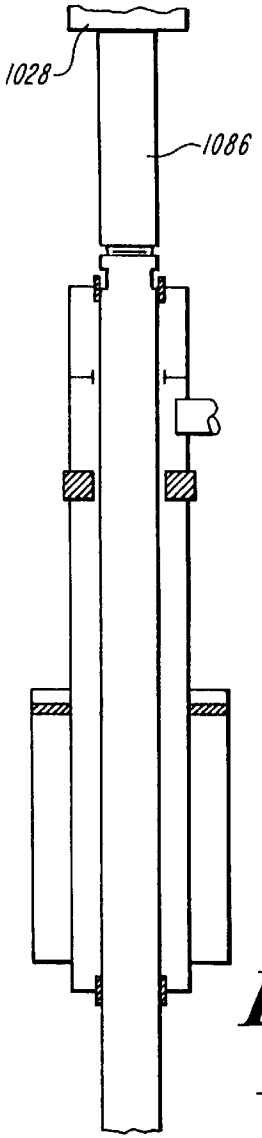
Figure 11E:
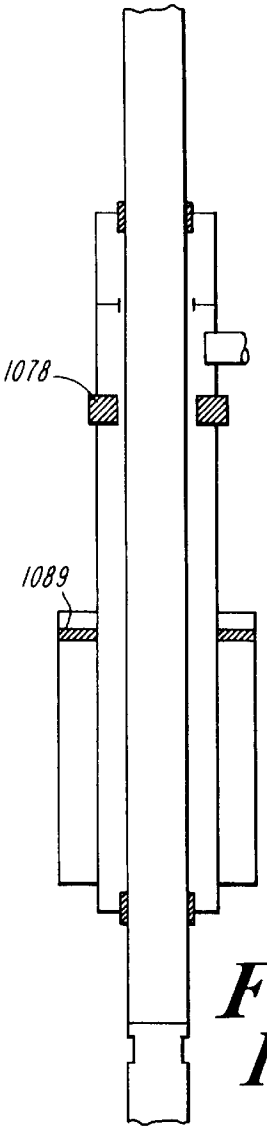
Figure 11D:
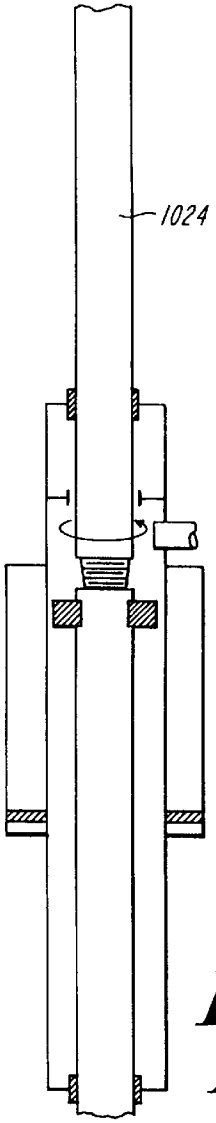

This state is shown schematically in FIG. 11C. In order to maintain air and water to the flame jet as continuously as possible, during the time that it takes to thread an additional length of new feed pipe 1024 to the grown length 1004, the two component mixture from the supply unit (air and water) is introduced into the pipe adding chamber 1018, and thus into the length of pipe 1004, through the alternative hose 1044 and the spallation components inlet port 1050. Meanwhile, the power swivel 1028 is lifted back to a starting position by the cable 1032 and a length of new pipe 1024 is added and advanced into the pipe entry port 1026 as the growing pipe length is lowered further into the borehole by the descending dogs 1078, as shown in FIG. 11C. As shown in FIG. 11D, the leading end of the new length of pipe is brought to engage the trailing end of the already assembled length of pipe. The threads are engaged and flow is returned through the primary hose 1040 and the power swivel 1028. At this point the weight of the entire assembly is transferred to the rig system and the entire length of pipe is again supported by the pulley 1030 and the cable 1032. The dogs 1078 are retracted and the hydraulic piston 1089 is returned to the top of the cylinder 1090, as the trailing end of the next new length of pipe is added, as shown in FIG. 11E. The process is then repeated (FIG. 11F). Flush joint coupling may be used to simplify the sealing issues.

The foregoing has described how a new length 1024 of feed pipe is added. The procedure is the same for adding a new length of return pipe 1025, except that instead of the supply apparatus 1036 being alternatively connected through the power swivel 1028 and the new pipe adding chamber 1018, it is the product handling apparatus 1058, that is alternatively connected through the power swivel 1028 and the respective new pipe adding chamber 1019. Tandem apparatus, as described above for the feed pipe, such as the various seals, and dogs and hydraulic lift, are provided for the return pipe also.

The bearing surface of the entry and exit seals to the pipe adding chamber must be long enough to span the detents 1068 at the trailing end of each pipe section. If collared pipes are used, rather than detents, dual entry and exit seals can accommodate the change in pipe diameter at the collars and still provide adequate sealing.

Thus, through a combination of the pipe adding chambers 1018, 1019, the hydraulic lowering device 1090, the alternative hoses 1044, 1060, combustion air and cooling components are provided to the system safely and continuously.

By use of the foregoing apparatus, it is possible to spall rock continuously. This has several distinct advantages. The downward moving fluid feed column remains in steady motion. This facilitates analyzing its condition, and thus controlling the flow if desired. Further, the spalls are moving upward under the influence of the combustion products. It is very important to keep the spalls moving upward, and to prevent intermittent settling. Further, it is also beneficial to maintain the thermal aspects of the drilling as uniform (in time) as possible, again, to facilitate analysis and control.

There are several embodiments for the provision of fuel to the down-hole apparatus. According to the embodiment shown schematically ion FIGS. 10A, and 10D fuel is supplied through line conduit 1011, which is maintained on a roll 1013. A disadvantage of this embodiment is that fuel must pass through the entire length of its passageway regardless of the depth currently being drilled. The frictional pressure drop must be compensated for by surface pressurization. As length is added "hydrostatic" pressurization compensates for some of this added surface pressurization.

An alternative embodiment uses an additional drill string for the provision of fuel. The fuel "line" can be a small diameter conventional oil field tubing new lengths of which are added in the same way as are added new lengths of the feed and return pipes. It would not be necessary to provide continuous flow during connection of new lengths because of the down-hole fuel storage capacity.

The apparatus thus described achieves many of the goals discussed above. It provides a means for removal of rock that does not require direct mechanical contact between the removal apparatus and the rock. Spallation takes place more uniformly over a relatively wide surface area, rather than being concentrated at the center of the spalling interface. Conventional drill pipe can be used, since the air and water are provided to the deep down-hole site in a single mixture. The rock removal can continue uninterrupted. There is no rotating drill string, so electromagnetic two-way communication between the surface and the down-hole apparatus is possible through a conduit. This same conduit may provide a passage for fuel transport. The rock removal apparatus experiences virtually no lateral forces, and hangs like a plumb bob, so that the only significant forces on it are tensile. The temperature at the spallation site can be controlled using cooling fluid to avoid overheating and melting of the rock. All of the foregoing results in an apparatus that can achieve great cost savings for generating very deep holes, at relatively high speeds.

The following variant is possible only with the low density embodiment of the invention. Through control of the pressure in the combustion chamber 610, it is possible to increase the pressure change across the flame jet nozzle, to a level where the chamber pressure is approximately two times the pressure at the spalling front (the critical ratio) resulting in a supersonic jet if the flow is through a properly shaped nozzle. At shallow depths, this pressure change can be achieved by increasing the surface injection pressure. This is not a desirable method because it requires a constantly changing compressor pressure as the drilling depth increases.

Figure 20:
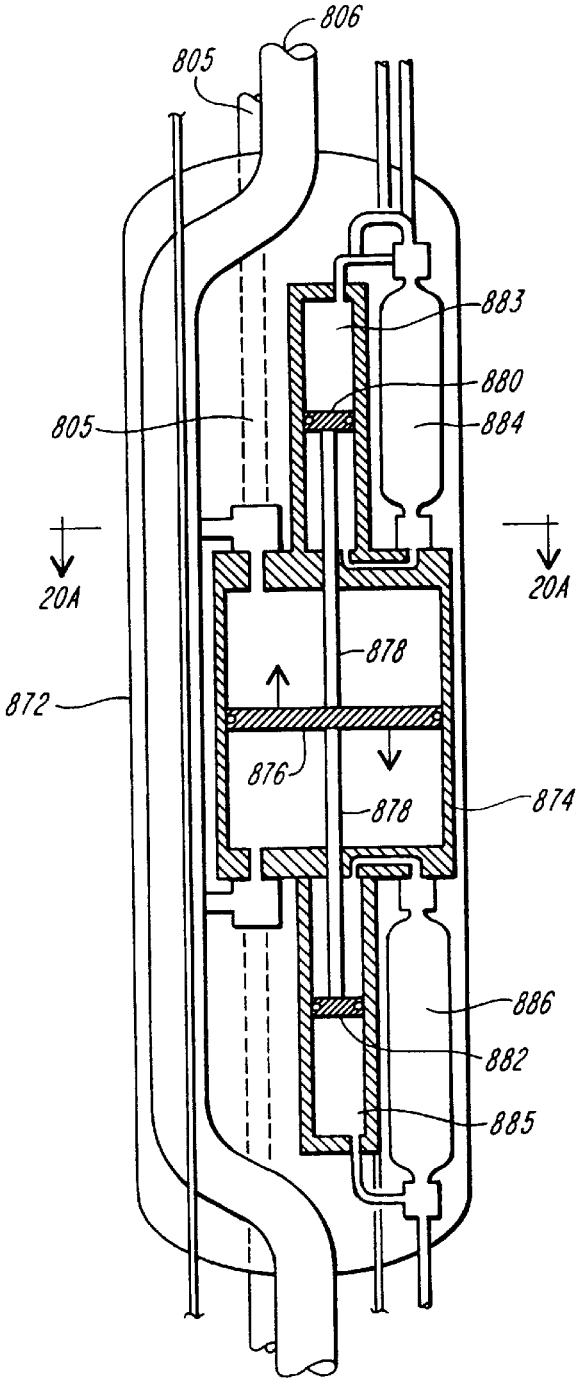
FIG. 20 is a schematic representation in elevational cross-section of a water driven pressure intensifier for air and fuel.
Figure 20A:
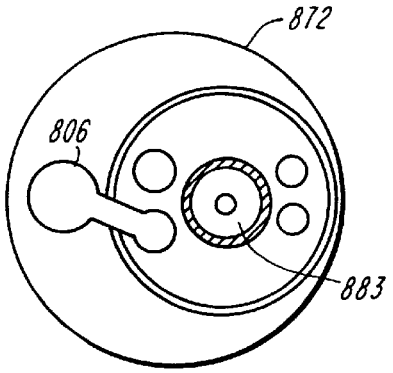
FIG. 20A is a schematic representation in plan cross-section of the pressure intensifier shown in FIG. 20, along the lines 20A—20A.

A better alternative is through the use of a down-hole pressure intensifier 872 (FIG. 9), located between the fuel storage 832 and the mechanical apparatus 842. FIGS. 20 and 20A illustrate such an apparatus in detail. Separated water 805 is fed alternating into each chamber of a floating piston chamber 874. The piston 876 is attached to a connecting rod 878 which extends through both the top and bottom of the chamber. Each extension of the rod feeds into another chamber (883, 885) and in turn is connected to smaller floating pistons 880, 882, respectively. The upper chamber 884 is for fuel and the lower chamber 886 is for air. Each of the smaller chambers has valving run synchronously with that of the water chamber, producing pressure intensified flows which are stored in high pressure vessels 884 and 886. Fuel and air are fed from their storage vessels to the combustion chambers 610.

The apparatus described produces constant volume changes in each chamber. The different compressibilities of each fluid and their different differential changes with changing depth must be considered when designing the equipment along with bypass flow capability.

It is not necessary to achieve the pressure needed for full supersonic expansion to gain substantial increases in heat transfer. However, success in achieving supersonic flame jets will provide even higher heat transfer rates and more importantly a much greater mechanical energy flux for spall detachment.

HIGH-DENSITY COMBUSTION JET SPALLATION

Figure 13:
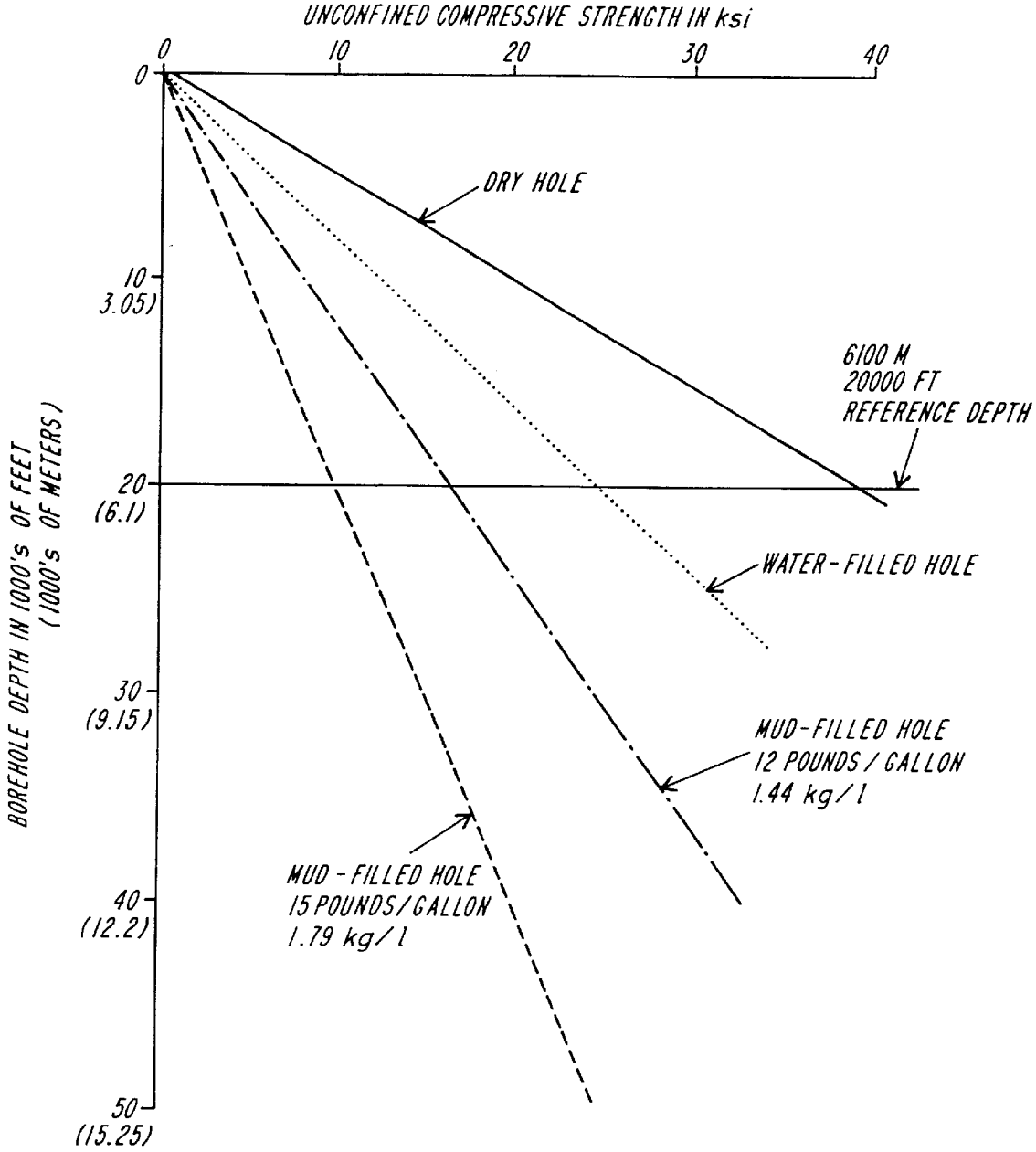
FIG. 13 is a graphical representation showing estimated rock strengths needed for stable boreholes as a function of hole depth.

In the prior art, an empty (dry) wellbore (one occupied by low density gases such as compressed air and/or combustion products) that is stable to the desired depths has been used. Although spallation automatically creates a minimum stress borehole profile, the formation still must be sufficiently self-supporting and stable to stay open. It has been estimated that an approximately six km (20,000 ft) deep dry hole would require an intrinsic rock strength of greater than 3,040 bar (43,000 psi) to be stable. FIG. 13 shows graphically the relation between borehole depth and unconfined compressive strength for holes filled with various fluids.

The rotating head spallation apparatus discussed above can be used with either a dry borehole, or one filled with a fluid. However, in many cases, increasing the density of the fluid in the "empty" borehole would increase the depth to which stability is maintained.

Another benefit that is derived from a fluid filled borehole is the ability to control or eliminate pore fluid inflow, which is a common problem in conventional rotary drilling. Water loss to the formation from a fluid filled borehole presents difficulties to the spallation process and is one of the reasons that the dual pipe mode shown in FIG. 5F has significant advantages over other modes. The need to drill to ten km or deeper requires a higher density fluid, possibly approaching or exceeding that of liquid water. Another preferred embodiment of the method and apparatus of the invention will cause the rock interface to spall in a manner similar to that occurring with the combustion flame-jet technology discussed above, but with a high density fluid filling the borehole.

Several studies indicate that the heat flux into the rock surface just prior to spallation is the main determining factor in the process. (R. M. Rauenzahn and J. W. Tester, "Numerical Simulation and Field Testing of Flame-jet Thermal Spallation Drilling—I. Model Development, and II. Experimental Verification" *Int. J. Heat Mass Transfer,* 34(3), pp. 795–818 (1991); M. A. Wilkinson and J. W. Tester, "Computational Modeling of Fluid Flow and Heat Transfer Effects During Supersonic Flame-jet Induced Rock Spallation" (*Int. J. Heat Mass Transfer*), 36(14), pp. 3459–3475 (1993) and "Experimental Measurement of Surface Temperatures During Flame-Jet Induced Thermal Spallation," *Rock Mechanics and Rock Engineering,* 26(1), pp. 29–62 (1993).) The heat flux is a factor in the penetration rate (of the hole in its axial direction) along with the onset temperature of spallation.

This embodiment of the apparatus and method of the invention is referred to as "high-density-combustion jet spallation." The term "high-density-combustion" means that there is at the bottom of the drill string an exothermic combustion proceeding at pressures equal or greater than the hydrostat existing in the wellbore. Further, the annulus of the wellbore around the feed and return pipes is filled with a fluid having a density near that of water. Expansion of the products of this combustion through a nozzle produces a high density flame jet whose pressure is slightly greater than that of the fluid contained in the annular regions surrounding the drilling apparatus.

The apparatus to be used is, in principal components, the same as that discussed above, as illustrated in FIGS. 6, 7, 9, and 10A, with suitable modifications resulting from changes due to the large density difference between the environments in which the two embodiments operate. A major difference in the method of using the apparatus is in the mass ratio between the combustion air and the water. For a low density embodiment discussed above, $M_{H_2O}/M_{air} \cong 2$ (between about 1 and 10), while for the high density embodiment specifically discussed below, $M_{H_2O}/M_{air} \cong 100$ (between about 50 and 200), an increase of about fifty.

For this high-density-combustion jet embodiment, the down-hole spallation energy source is a dense, hot, fluid phase (possibly supercritical) at drilling depths greater than ~7500 ft (~2,290 m)), that is obtained by direct combustion of a pressurized mixture of air and fuel. Most low vapor pressure hydro-carbon fuels, such as kerosene, diesel fuel, fuel oil, etc., are suitable. Compressed air is injected under modest pressure ~35 bar (~500 psi) into the flow of water from the supply unit 1036 at the surface and is separated down-hole using centrifugal apparatus between components as discussed above. The compressed air is transported as bubbles in the water liquid phase, with the bubble pressure equal to the local hydrostatic conditions at any particular depth. Even at great depths (10 km), the solubility of nitrogen and oxygen (the major constituents of air) in the water phase is quite low (less than 5% by wt.). Thus, most of these elements remain in the gas phase. Furthermore, the density of these gases at any depth is always less than that of liquid water, allowing relatively easy separation by centrifugal means.

Combination of a stoichiometric mixture of the separated compressed air and fuel permits rapid oxidation having an exothermic heat of combustion that produces a hot ($T \geqq 1800°$ C.) fluid mixture of water, nitrogen and carbon dioxide to be expanded as a subsonic jet between the combustion chamber 610 and the spallation zone in the hole.

This jet flow at Reynolds number of 3 to 4 million can produce stagnation heat fluxes of 10 to 20 $Mw/m^2$ (see for example, E. E. Anderson and E. F. Stresino, "Heat Transfer from Flames Impinging on Flat and Cylindrical Surfaces," *Journal of Heat Transfer,* pp. 49–54, February (1963); B. N. Pamadi and I. A. Belev, "A Note on the Heat Transfer Characteristics of Circular Impinging Jet," *Int. J. Heat Mass Transfer,* 23, pp. 783–787 (1980); Cz. O. Popiel, Th.H. van der Meer and C. J. Hoogendoorn, "Convective Heat Transfer on a Plate in an Impinging Round Hot Gas Jet of Low Reynolds Number," *Int. J. Heat Mass Transfer,* 23, pp. 1055–1068 (1980)).

A portion of the separated water flow is passed through the flame jet head 602 as a cooling flow exiting 630 into the central exit passage 620 mixing with and significantly cooling the hot combustion products and spalls. The bulk of the separated water is passed through a turbogenerator into the return paths where it mixes with the cooling water flow. The total water flow enters the return pipe 620 which has a flow area sized to produce a flow velocity sufficient to overcome friction losses and sufficient lift to transport the spalls.

Figure 14A:
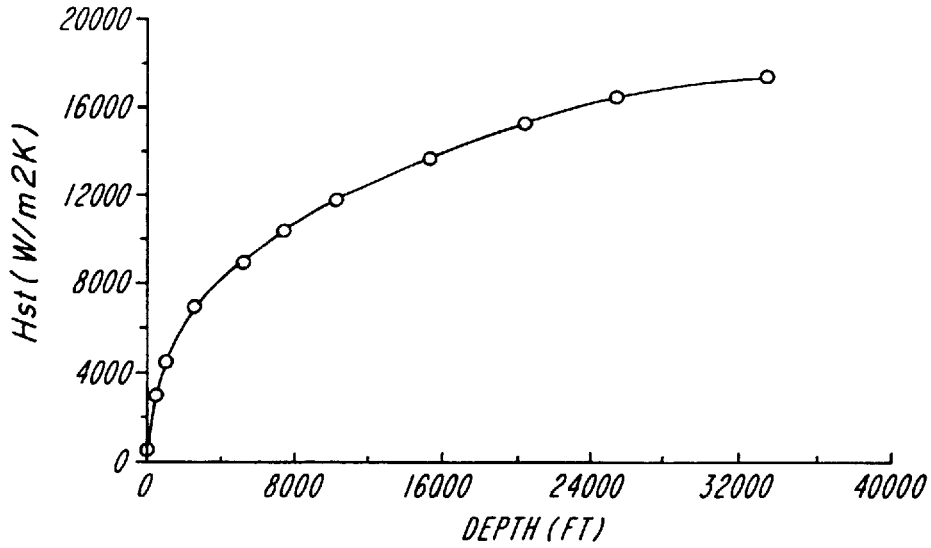
FIG. 14A shows schematically the estimated heat transfer coefficients for submerged flame jets in a pressurized water environment, from zero to forty thousand feet deep.
Figure 14B:
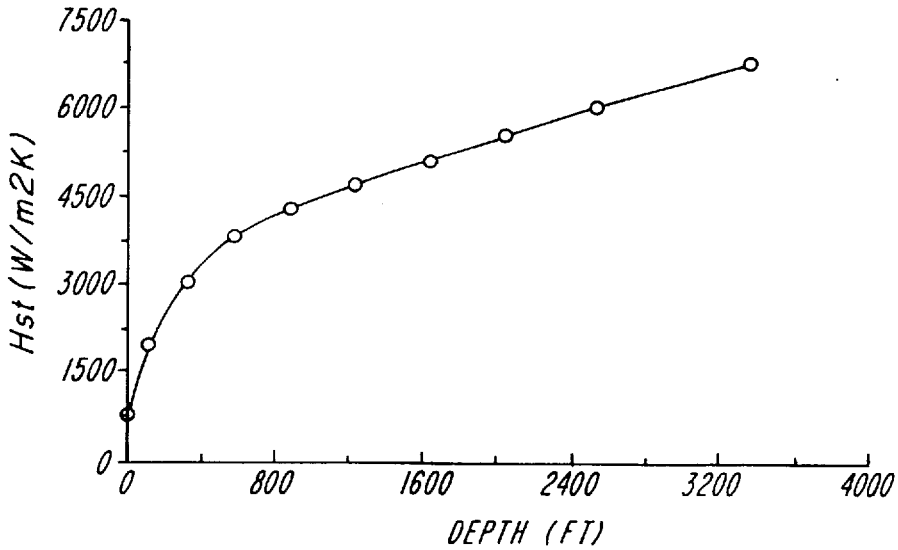
FIG. 14B shows schematically the estimated heat transfer coefficients for submerged flame jets in a pressurized water environment, as shown in FIG. 14A, from zero to forty thousand feet deep.

Significantly higher heat transfer coefficients arise from pressurization, which provides significant opportunities. FIGS. 14A and 14B show the relation between depth and estimated heat transfer coefficients for submerged flame jets in a pressurized water environment, with FIG. 14A extending to depths of 12,200 m (40,000 ft), and FIG. 14B ranging to depths of only 1,200 m (4,000 ft).

Lower flame temperature may be coupled with a very large heat transfer coefficient. This allows spallation of rock types with low brittle-to-ductile transformation temperatures (e.g., limestone, phyllites, etc.) Rather than achieving potentially higher drilling velocities, smaller quantities of air and fuel may be used. Both are key contributors to utility costs.

ELECTRO-KINETICALLY HEATED WATER SPALLATION

Figure 15:
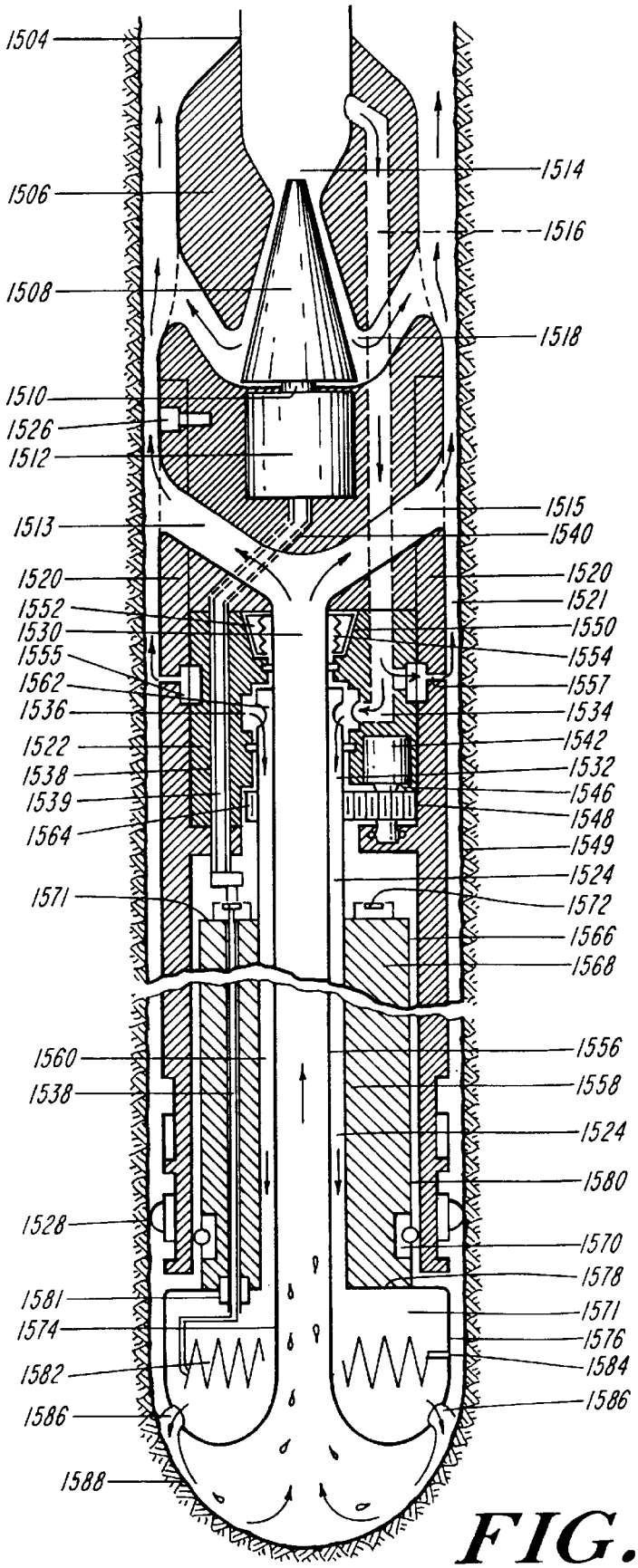
FIG. 15 is a schematic representation in elevational cross-section of the flame jet of an electro-kinetically heated supercritical water embodiment of a spallation apparatus in place in a borehole, surrounded by high density fluid for addition borehole stability.

Rather than using chemical sources of energy, according to another preferred embodiment of the invention, illustrated in FIG. 15, the thermal energy needed for spallation is generated from conversion of the kinetic and pressure energy of the circulating fluid stream to electrical energy by means of a down-hole electrical-turbo generator and resistance heater.

As in the previously described hydro combustion embodiments, most of the length of piping is conventional drilling pipe which is not shown. The conventional piping is terminated 1504 in a power generation housing 1506. This housing contains a hydraulic turbine 1508 from which a drive shaft 1510 turns an electrical generator 1512. A pressurized flow of water originating from the action of rig pumps on the surface drilling rig and subsequently passing through the drill pipe enters the turbine entrance 1514. A portion of this flow also enters a working fluid passageway 1516, providing the working fluid that will be heated by electrical resistance. The flow entering the turbine delivers its pressure and kinetic energy to the rotor 1508 and is vented to the hydrostatic annulus 1518 around the turbine. The rotation provided by the turbine produces a steady flow of electricity from the generator.

A tubular extension 1520 of the power generation housing 1506 provides support and containment for both the utility distribution structure 1522, and a rotating heat exchanger assembly 1524. The tubular extension 1520 is fastened into the power generation housing 1506 at its upper end by bolts 1526. At its lower end a dual packer set 1528 as generally described in connection with FIG. 7 provides centering and prevention of any fluid bypass.

The cylindrical utility distribution structure 1522 contains the following features. A central circular passage 1530 contains the upper end 1532 of the rotating heat exchanger assembly 1524. A right angle or "dog-leg" passageway 1534 has an upper end that meets the lower end of the working fluid passageway 1516. The terminus 1534 of the horizontal branch of this working fluid passageway ends in an annular plenum 1536 centered on the axis of the circular passage 1530. A feed through 1538 is provided for the insulated electrical conductor 1539. The upper end of the feed through 1538 meets the lower end of an insulated conductor passage 1540 in the power generation housing 1506. An electric motor 1542 is fed by an insulated conductor through passageways (not shown) similar in design to that used for the other conductor 1539. The motor shaft 1546 is connected to a driving gear 1548. A tapered conical cavity 1550 at the top of the utility distribution structure 1522 contains a tapered roller bearing 1552 (apex facing downwards). The roller bearing contains an interior threaded female passage 1554 into which the threaded male top of the heat exchanger assembly 1524 is screwed. The screw direction is opposite to the rotational direction of the heat exchanger thus insuring a safe connection.

The rotating heat exchanger assembly 1524 has the following features. An inner 1556 and outer 1558 wall define an annular column 1560 that is the down going path for the working fluid. The upper end of the outer wall 1558 is a tube that is fastened to a tube that is the inner wall 1556. A series of ports 1562 in the outer tube allow continuous flow communication with the annular plenum 1536 and the annular column 1560. A gear 1564 fastened to the outer wall tube 1558 meshes with the motor gear 1548 providing controlled rotation of the heat exchanger assembly 1524. A cylindrical capped tube 1566 filled with thermal insulating material 1568 surrounds the heat exchanger assembly 1524 (and rotates with it). The bottom end of the insulator jacket 1568 contains a lateral thrust plate 1570 also supported by the tubular extension housing 1520. The cap 1571 of the insulator jacket 1568 supports an electrically insulated metal ring 1572, which is connected to a primary electrical conductor 1539. Continuous electrical connection to the resistance element 1582 (discussed below) is provided by a spring loaded roller connected to the conductor 1539, which makes contact with the electrical metal ring 1572.

The lower end of the rotating heat exchanger assembly 1524 is connected to the heat generation chamber 1571. This toroidal chamber has the following features. An inner wall 1574 that is connected to the inner wall tube 1556 of the heat exchanger. The outer wall 1576 and top 1578 of the "torus" are similarly connected to the outer wall tube 1558 of the heat exchanger. The outer insulator jacket wall 1580 is also connected to the top 1578 of the toroidal chamber. The electrical conductor 1538 is brought through an electrical 1581 insulator in the chamber top, and connected to an electrical resistance heater 1582. The heater is electrically grounded into the torus wall 1584. The heat generation chamber 1571 has multiple nozzles 1586, arranged as described above in connection with the chemical energy embodiments (e.g., FIG. 6), allowing the heated working fluid to jet against the spalling surface 1588.

The heated fluid carrying the spalls passes up the interior of the heat exchanger transferring heat through the inner tube and finally exiting through passages 1513 and 1515 into the annulus surrounding the power generator housing 1506. Because of the large density contrast between the spalls and the exiting fluid, the possibility exists for a small percentage of the spalls to settle downward in the annular space 1521 between the tubular extension housing 1520 and the borehole wall 1549. To prevent this, an additional upward flow is created in the working fluid passage 1516 exiting into a plenum 1555 lying between the tubular extension housing 1520 and the utility distribution structure 1522. A series of small diameter holes 1557 carry this additional flow into the annular space 1521 and then upwards, thus providing a hydrodynamic barrier to downward spall intrusion.

With optimal design and good insulator properties, a significant fraction of the heat leaving the bottom of the hole is recirculated requiring a minimum amount of generated electrical energy.

For either of the two high density embodiments (hydrocombustion jet or electro-kinetic water) a significant reduction in the thermal energy required to bring the spallation working fluid (fuel or water) to the operating temperature can be achieved by counter-current heat exchange between the fluids entering the combustion chamber 610 (FIG. 6) or alternatively the resistance heater chamber 1571 (FIG. 15) and the hot exiting fluid that entrains the spalls. In the hydro combustion case, a reduction in the amounts of fuel and combustion air would be achieved. In the electro kinetic case, it is much more important because the amount of pressure and kinetic energy derived from practical rates of injection flow is significantly less than can be achieved by the same flow rates using the hydrocombustion process.

It is always possible in both the low and high density operating modes to withdraw the drill pipe and return to conventional rotary drilling, if the formation is resistant to thermal spallation.

NON-VERTICAL HOLE FORMATION

Figure 16A:
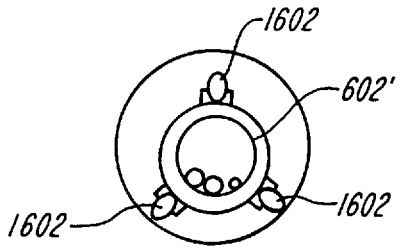
FIG. 16A is a schematic end view representation of the wellbore and spallation drilling head shown in FIG. 16, from the end near the spallation head.
Figure 16:
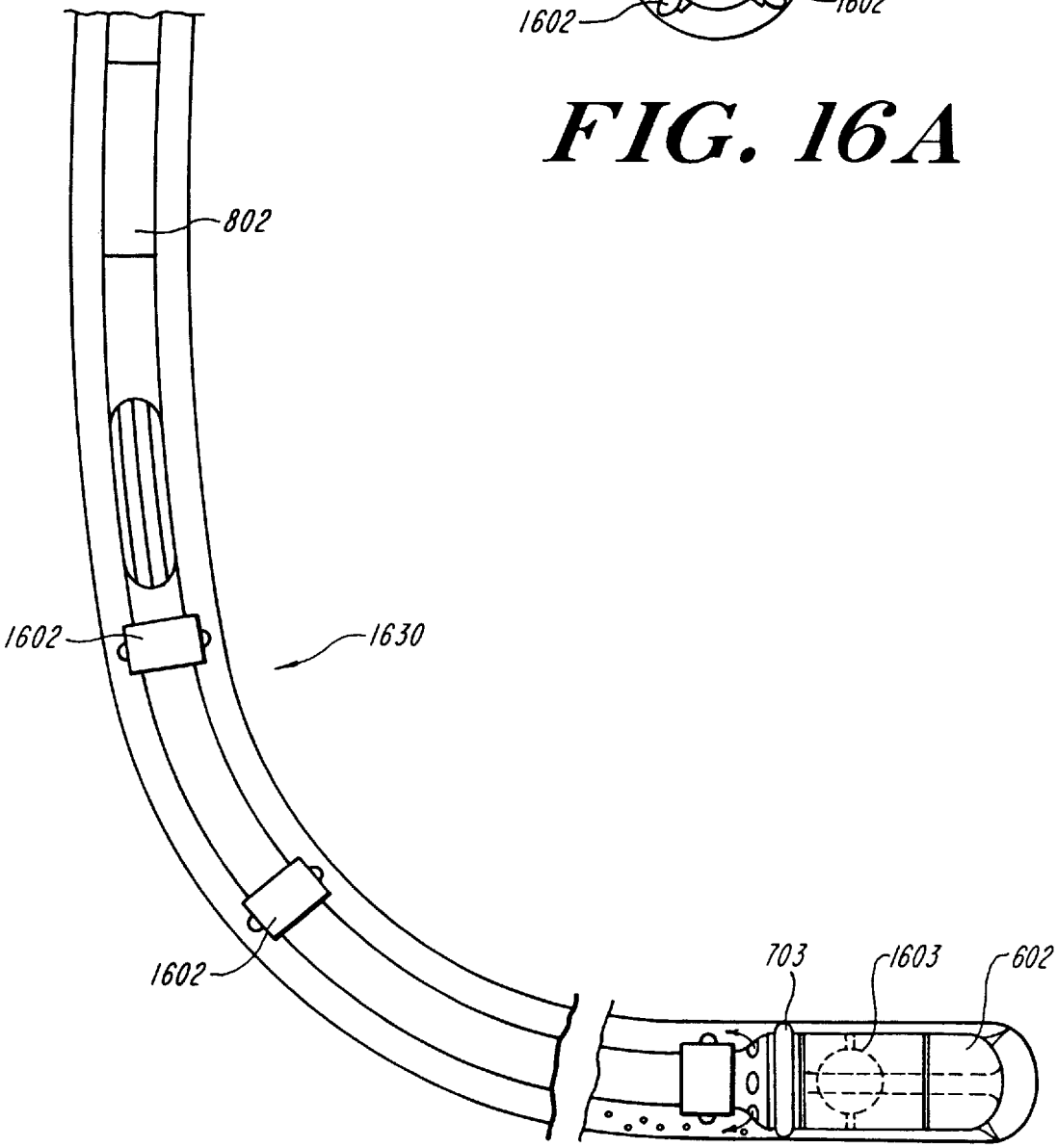
FIG. 16 is a schematic representation in elevational cross-section of a deviated wellbore being drilled with a flexible extended spallation drilling head.

Although great emphasis has been placed herein and in the literature on the virtues of completely vertical drilling, many uses of deep, thermally spalled wellbores will require some degree of deviation from vertical at an arbitrary depth or depths. While a mechanical system can be built to alter the effective angle of attack of the flame jets, the resulting radius of curvature is limited by the allowed bending of the supporting structure and accompanying frictional forces. A better arrangement, shown schematically in FIGS. 16 and 16A, is to remove the assembly to the surface and remove the portion below the air/water separator 802. A length of flexible drill pipe 1630 (commercially available) is then attached. It contains a continuation of the three fluid passageways (air, water and fuel) and is terminated in a modified version of the flame jet housing spalling head 602'. This modified housing consists of sensors and actuators, which determine and control both the local orientation and deviation (from vertical) of the spalling head 602. A modified dual packing assembly 702' along with a flexible joint 1603, located just to the rear of the spallation head 602,, allows a fixed deviation in the spallation angle of attack from that of the supporting assembly.

Drilling of boreholes at or near to the horizontal is of great value. Thermal spallation technologies described in these embodiments offer special advantages over conventional methods such as rotary drilling. Directional control in the presence of high gravitational downward forces relative to the direction of drilling requires constant attention to directing mechanisms. The relative ease of directing the angle of attack of the flame jets allows the assembly to follow a determined path. Non rotation of the "drill string" allows occasional wheeled supporting assemblies 1602, thereby greatly reducing friction. The plate-like structure of the spalls greatly increases their transportability by the returning annular fluid flow.

SCOURING OF EXCAVATION SITE BY JETS

In the discussions above, attention has mainly been directed toward the effect of the pressure of a hydrostatic column on the ability to deliver heat at very high rates into a rock surface. Indeed as FIGS. 14A and 14B show, subsonic jets of superheated combustion products produce heat fluxes that will cause very high rates of thermal spallation and consequently very rapid drilling rates.

In step with this potential for increased spallation rate is a reduction in the mechanical energy flux resulting from lowered fluid velocities (assuming no change in the geometry and size of the spalling cavity).

Reduction in the standoff distance (the distance between the drilling tool and the spalling surface) will increase the fluid velocity as it strikes the excavation surface, all other things being equal. Other effects may arise from increased density, which will hinder the spallation process. The mechanical spall release mechanism is one example where increased fluid density could be inhibiting.

The several embodiments of spallation drilling apparatus have shown long paths for the jet output substantially parallel to a large fraction of the surface to be spalled. These designs do not produce strong mechanical spall removal processes.

UNIFORM HEAT FLUX MULTI-JET SPALLATION

The embodiment shown in FIGS. 18, 18A, and 18B, discussed below, periodically provides the very valuable jet scouring at all points on the spalling surface.

A rotating multi-jet structure, with centrally facing jets located on a regular spiral pattern, will produce periodic times of intense heat transfer at every point on the horizontal drilling front. Depending on the nature of the rock being heated, spallation may take place and the drilling process will continue in a smooth fashion. If spallation does not occur, the temperature of the rock surface will rise very rapidly, until some degree of fusion occurs. During the early stage of this process, the intense thermal gradient created in the rock will cause microcracks to occur, which in turn will allow the permeation of high temperature water.

Figure 17:
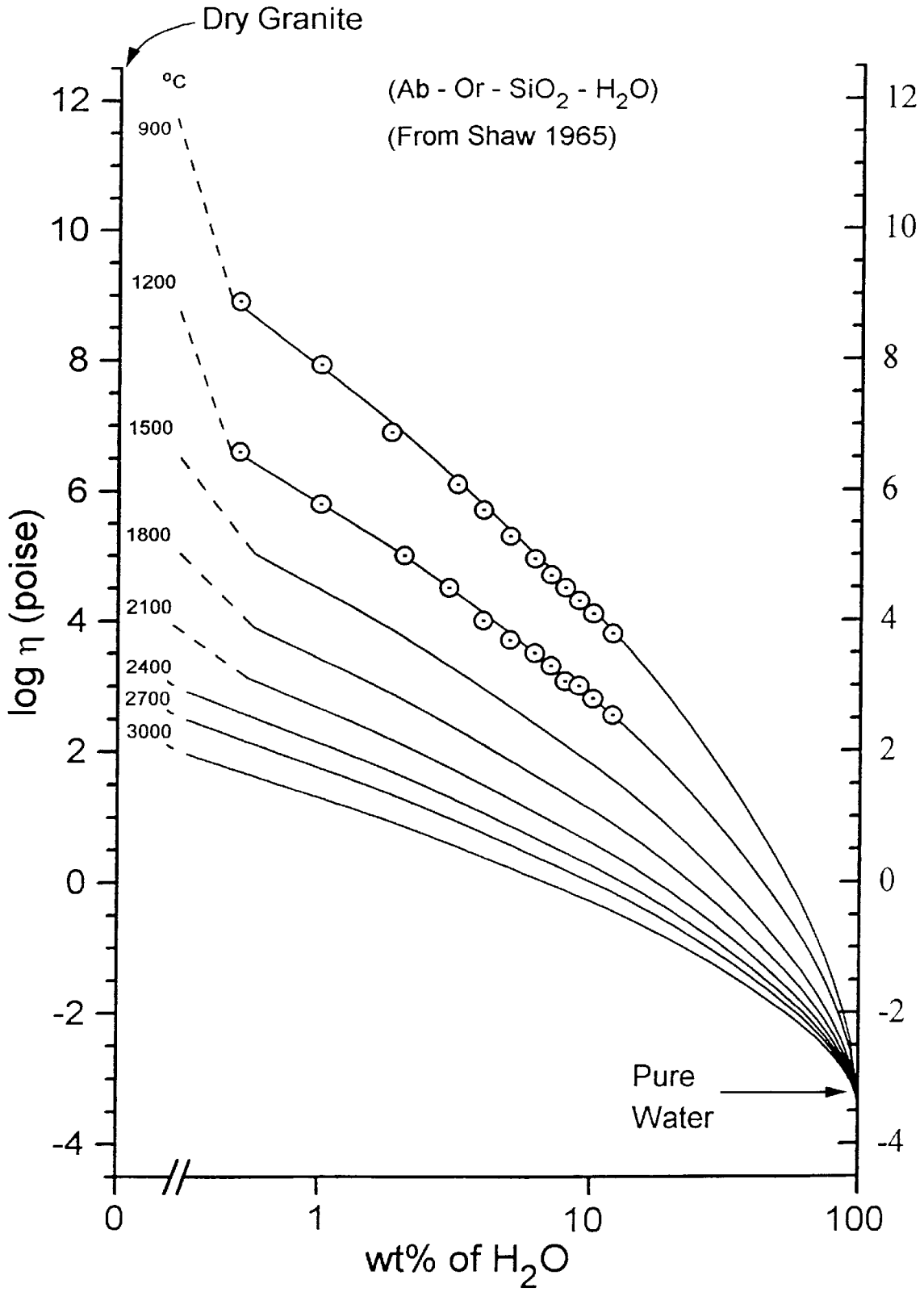
FIG. 17 is a graphical representation of the viscosity of granite as a function of temperature and dissolved water.

FIG. 17 illustrates the very strong fusion promoting (fluxing) action of water on granitic rocks. FIG. 17 is based on measured physical data (the circle points), which represent measured viscosity of granitic rocks as a function of water content and temperature. The lower 6 lines (temp 1500° C.–3000° C. are based on the extrapolated values of the viscosity at a fixed amount percent of water to higher values of temperature. The extrapolations are not necessarily accurate, but are reasonable. The dashed portions of the upper two lines are extrapolations also.

The resulting exponential decrease in rock viscosity with increasing percent of water allows the jets to rapidly remove the resulting fluid rock interface, because the viscosity is low enough to allow flow under the pressure of the exiting gas flow. Colder rock is exposed underneath. The very small size of the resulting fractured matrix should allow rapid equilibration between the rock and very mobile supercritical fluid. The resulting process is similar but not quite as effective as thermal spallation.

Figure 18A:
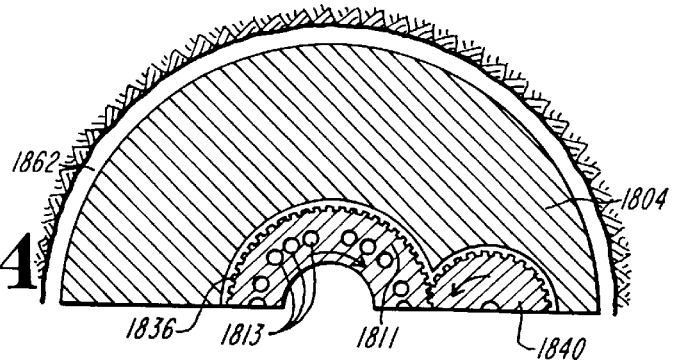
FIG. 18A is a partial cross-sectional view of the apparatus shown in FIG. 18, along the lines 18A—18A.
Figure 18:
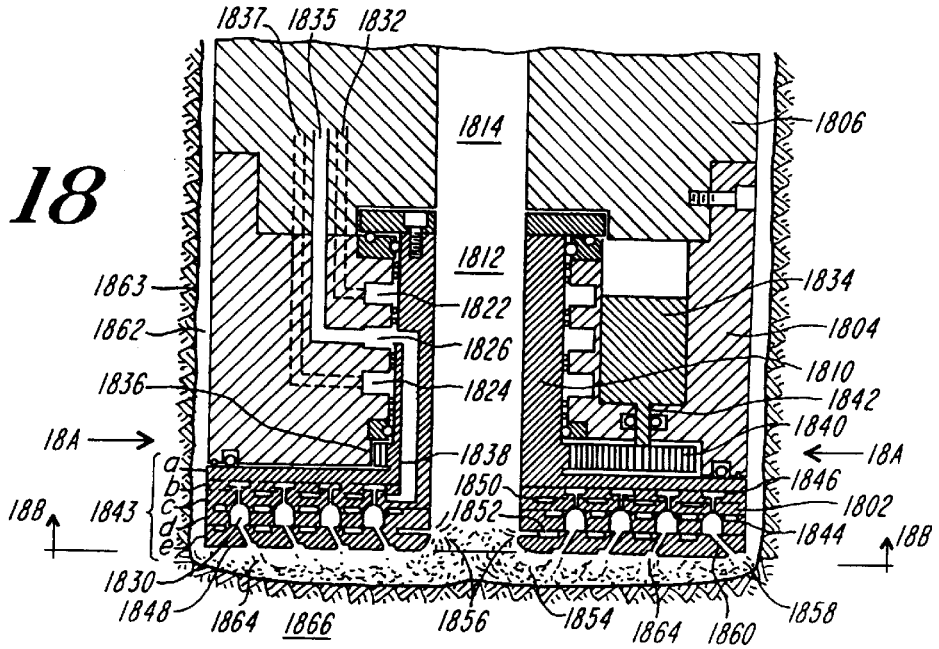
FIG. 18 is a schematic representation in elevational cross-section of a uniform heat flux multi-jet embodiment of a spallation apparatus that will continue to drill in situations where rock fusion occurs rather than-spallation.
Figure 18B:
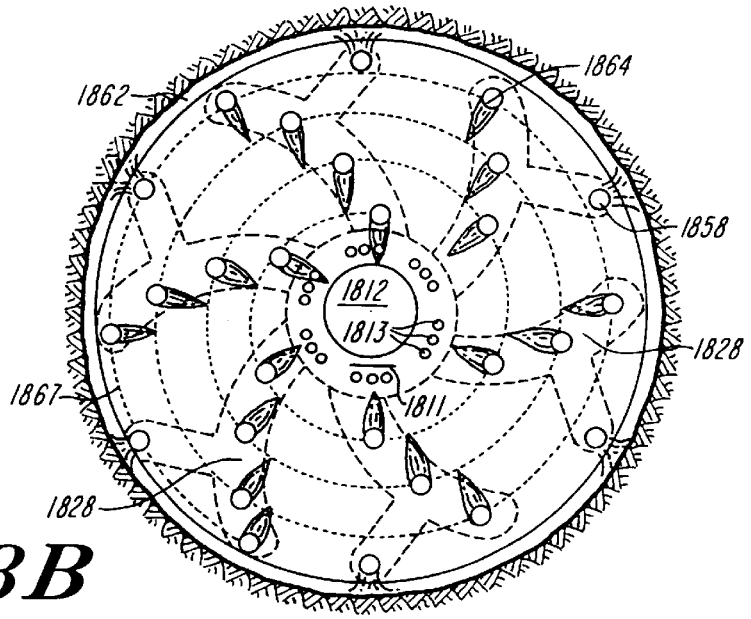
FIG. 18B is an end view of the apparatus shown in FIG. 18, from lines 18B—18B.

As shown in FIGS. 18, 18A, and 18B, the rotating multi-jet drilling head 1802 is centered in and supported by a support structure 1804. The support structure in turn is connected to a transition member 1806, which connects to the dual packer assembly 702, such as shown in FIGS. 7 and 9.

The rotating multi-jet head 1802 has a disc-like structure with a central columnar extension 1810, which has a central opening 1812. This opening 1812 connects to a similar opening 1814 in the transition member 1806, which in turn connects to the central opening 620 in the dual packer assembly 702.

The central hollow column 1810 has six groups 1811 (FIG. 18B) of three passages 1813 each, which conduct air, fuel, and water from the circular plenums 1822, 1824, and 1826 respectively, to the six circumferentially spaced branched feed zones 1828 that supply the fluid components for the combustion chamber 1830 fed from each zone. The circular annular plenum 1822 receives air from the passage 1832, which is connected to the air passage 618 (FIG. 6) in the dual packer assembly. In similar fashion, the water plenum is connected to the passage 614 and the fuel to the passage 616.

The multi-jet drilling head 1802 is rotated by an electric motor 1834 powered by current from the generator 860 (FIG. 8A). A gear 1836 mounted on the column just above the intersection 1838 between the column 1810 and the disc 1802, meshes with a driving gear 1840, which is rotated by the motor 1834 through a shaft 1842 causing controlled rotation of the entire multi-jet drilling head 1802.

The disc portion of the multi-jet drilling head 1802 may be constructed as follows. Five individual discs 1843*a*, 1843*b*, 1843*c*, 1843*d*, and 1843*e* (from top to bottom), each containing a different complex pattern of holes and relieved portions, are diffusion welded under pressure forming an array of precisely constructed small combustion chambers 1830, each with connections to the air and fuel plenums 1844 and 1846, which are fed by the appropriate feed conduits 1813 in the central column 1810. Leading from each combustion chamber 1830 is a properly oriented jet nozzle 1848. In a similar fashion, cooling water is circulated through the disc in two plenums 1850 and 1852, located above and below the combustion chambers 1830. The two plenums are cross-connected at the extreme end of each branch with the cooling water finally exiting into the central flow passage 1812 just above its lower end 1854 in a series of openings 1856.

In FIGS. 18 and 18B, six flame jets 1858 issue from nozzles 1860 located at the outer edge of the disc structure 1802 and are directed outwards and downwards. These jets 1858 remove the rock needed to create an annulus 1862 between the borehole wall 1863 and the drilling assembly 1802. This facilitates the frictionless passage of the entire drilling assembly. Movement of the hot combustion fluid upwards through the resulting exterior annular passage 1862 is prevented by the dual packer sealing in section 702. Primarily downward but slightly radially inward facing flame jets 1864 provide the great majority of the heat flux directed into the spalling (and/or melting) surface 1866. In addition, their high mechanical energy content provides periodic scouring of the drilling surface 1866.

To ensure that all of the target surface 1866 receives as constant a heat flux as possible, the radially inward facing flame jets 1864 in this example have been located on a regular spiral pattern 1866 shown as a dotted line in FIG. 18B. Each inward pointing jet 1864 travels with a unique radius about the central axis. This, coupled with the finite size of the jet stagnation region, results in a close approximation of the desired constant average heat flux over the surface being excavated.

FIG. 18 shows the rotation of the multi-jet drilling head 1802 produced by the action of the variable speed electric motor 1834. This capability to vary rotational speed provides still greater control of the rock removal process.

The thermal spallation drilling system illustrated in FIGS. 18, 18A, and 18B addresses a major concern, that thermal spallation drilling faces—namely dealing with rock types that do not spall, but instead fuse. The other embodiments mentioned above rely on both prompt removal of the spalls and on keeping the degree of surface fusion below that which would terminate the spalling process.

The nature of the entire spallation spectrum across rock types and depth induced physical processes is impossible to predict or to measure.

The rotating multi-jet apparatus of FIGS. 18, 18A and 18B, provides certainty in the drilling process. It produces the highest probability of spallation if the local situation allows it, and will automatically switch to the fusion mode if not. The thermal properties of all sedimentary formations are such that fusion drilling with this apparatus should be successful. The tradeoff for this confidence is the complication of the apparatus.

FINE CONTROL OF SPALLATION HEAD AXIAL TRANSLATION

As the number of jets are increased (assuming constant mass flux) in either the pure spallation embodiment of FIG. 6, or the hybrid spallation fusion embodiment of FIG. 18. the active length of each jet is correspondingly reduced. To produce the desired scouring action, the tip of the jet must touch the spalling/fusing surface. This requirement in turn necessitates a relatively small stand off distance. In the low density prior art devices, field experience (and theory) shows this distance is typically 5 to 10 inches (12–25 cm). In the multijet high density embodiment this standoff distance will be less than an inch (~2 cm). To maintain this small clearance between the drill face and rock surface through a controlled lowering mechanism located many thousands of feet away at the drill platform, requires an additional mechanism, shown schematically with reference to FIG. 4.

Local movement of the drilling head, relative to the steady downward motion of the entire drilling assembly located above the drilling head, provides the needed control. This local movement is directed by computer intelligence, using real time measurement of the stand off distance. The motion of the upper portion of the drill string can be halted periodically without cessation of steady drilling action during which stationary periods new lengths of feed 1024 and return 1025 pipe can be added. Therefore, if the down-hole relative motion device is used, the massive piston 1089 and automatic lowering device 1090 is not required, or at least can be reduced in size.

Such a capability provides: the "fine tuning" of motion needed to ensure the constancy of the standoff distance required in the high density embodiments and particularly in the uniform heat flux multi-jet embodiment; simplification of the drill string support and lowering equipment by eliminating the need for the massive support piston 1089.

Figure 4:
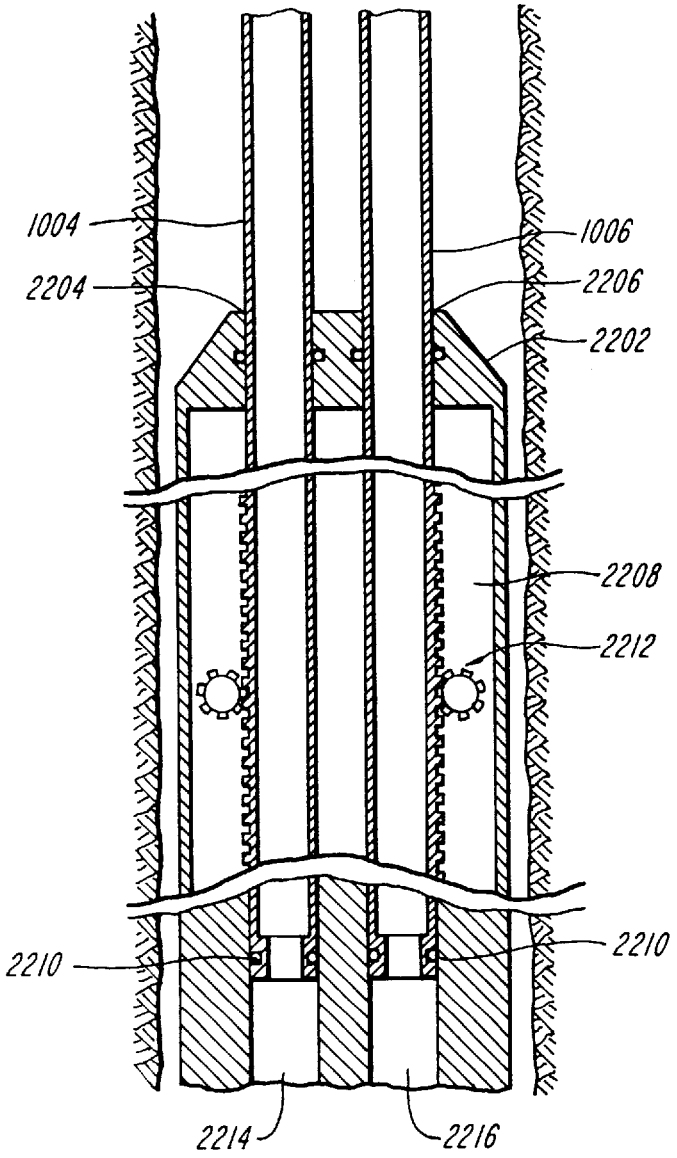
FIG. 4 is a schematic representation in elevational cross-section of an apparatus for providing differential travel of the spallation equipment and the major extent of the feed and return pipes.

FIG. 4 is a schematic representation of an assembly that is attached to the top of the drilling apparatus for instance, upstream of the air/water separator 802. The two drill pipes 1004, 1006 pass through openings 2204, 2206 in the differential motion apparatus 2202. This section has an internal cavity 2208 through which the drill pipes pass. The drill pipes terminate in extensions of the upper openings 2204, 2206. O-rings 2210 allow sealing in the presence of motion between the drill strings and the apparatus. The outputs 2214 and 2216 of these extensions mate with (or are) the appropriate tubing in the air/water separator i.e., 804, 806 respectively (FIG. 8A). Within the cavity 2208 rack and pinion assemblies 2212 allow the controlled differential motion. Each drill pipe is controlled separately, which allows compensation for differential motion between the drill pipes themselves due to temperature differences. There must also be provision for differential motion with respect to the fuel conduit 1011, typically in the same manner. This feature has not been shown in FIG. 4 in order to simplify the figure.

Conventional sensors and microprocessors (not shown) control the motion of the rack and pinions, which can be driven by electric motors powered by the turbo generator discussed above.

BUOYANT SUPPORT OF THE STRING

Figure 21A:
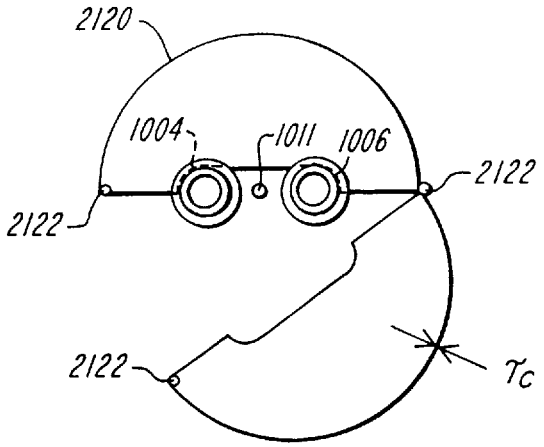
FIG. 21A is a schematic representation in plan cross sectional view, of the canister apparatus shown in FIG. 21, at lines 21A—21A.
Figure 21:
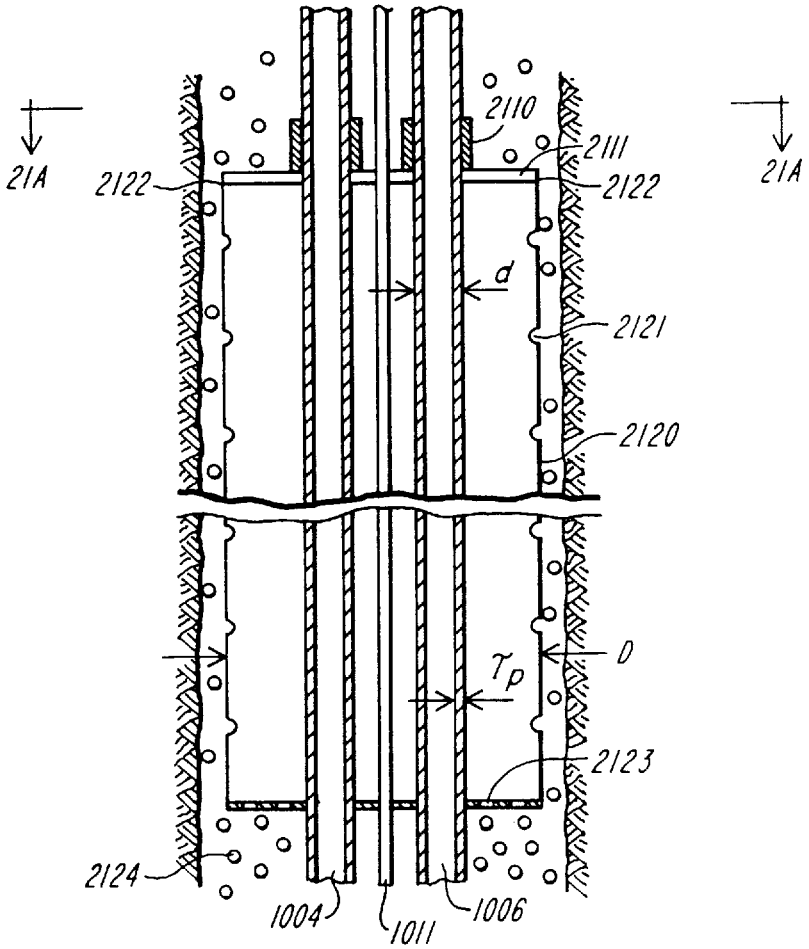
FIG. 21 is a schematic representation in an elevational view with some parts broken away, of an embodiment of the invention that uses hollow cannisters to provide buoyant support of the spallation string.

The presence of a large "stagnant" annulus of fluid in the high density mode allows the use of buoyant devices which, when attached periodically to the dual string pipe assembly, significantly reduces the needed string supporting stress. FIGS. 21 and 21A schematically illustrate this apparatus.

A split canister 2120 is placed around the dual pipe assembly as it is lowered through the rig floor opening. The drill pipe sections are connected to each other with couplings 2110, which provide a bearing point through which the buoyant stress is transmitted to the drill string through the thrust plate 2111. Pins 2122 lock the canister at both top and bottom. The bottom end of each canister half is pierced with many holes 2123 to allow both the entry and later egress of upward flowing bubbles 2124 that have been allowed to vent from the separated air flow in the drilling assembly. The thin canister walls are strengthened by corrugation 2121.

The initial mass of air contained in each canister would, with increasing depth of immersion, be compressed into a smaller volume at the top of the canister, thereby allowing water to enter the volume with an accompanying reduction of buoyancy. The addition of compressed air from the bottom ensures full "gas" occupancy and thereby maximum buoyancy.

On retrieval of the drill string, the compressed gas automatically starts to vent, always maintaining local hydrostatic pressure.

The following example illustrates the potential of this concept: FIG. 21A shows a cross section through the assembly shown in FIG. 21 at lines 21A—21A.

The buoyancy $B_c$ of the canisters per unit length is:

$$B_c \cong \left[ \frac{\pi}{4} D^2 - 2\frac{\pi}{4} d^2 \right] [\rho_w - \rho_g] g$$

where D is the diameter of the canister, d is the diameter of each of the pipes (feed 1004 and return 1006), $\rho_w$ is the local density of water, $\rho_g$ is the density of the gas bubbles, and g is the acceleration of gravity. The corresponding downward force F per unit length from the weight of the pipes and the canisters is:

$$F \cong (2\pi d\tau_p + (\pi(D+d)+2D)\tau_c)(\rho_p - \rho_w)g$$

where $\tau_p$ is the wall thickness of the pipe and $\tau_c$ is wall the thickness of the canister and $\tau_p$ is the density of the pipe material. For a representative arrangement, with d=4 inches (10.16 cm), D=10 in (25.4 cm), $\tau_p$=0.25 in (0.63 cm), $\tau_c$=0.125 in (0.32 cm), $\rho_p$=7.7 gm/cm$^3$ (for iron or steel) $\rho_w$=1 gm/cm$^3$ and $\rho_g$=0.1 gm/cm$^3$, Bc=53.4 g and F=95.6 g.

Thus 56% of the weight of the string would be supported by the buoyancy.

The use of lower density metals, such as high strength aluminum alloys ($\rho$=4.5 gm/cm$^3$) for both the drill string and canister will allow as complete buoyant support as is desired.

Figure 19:
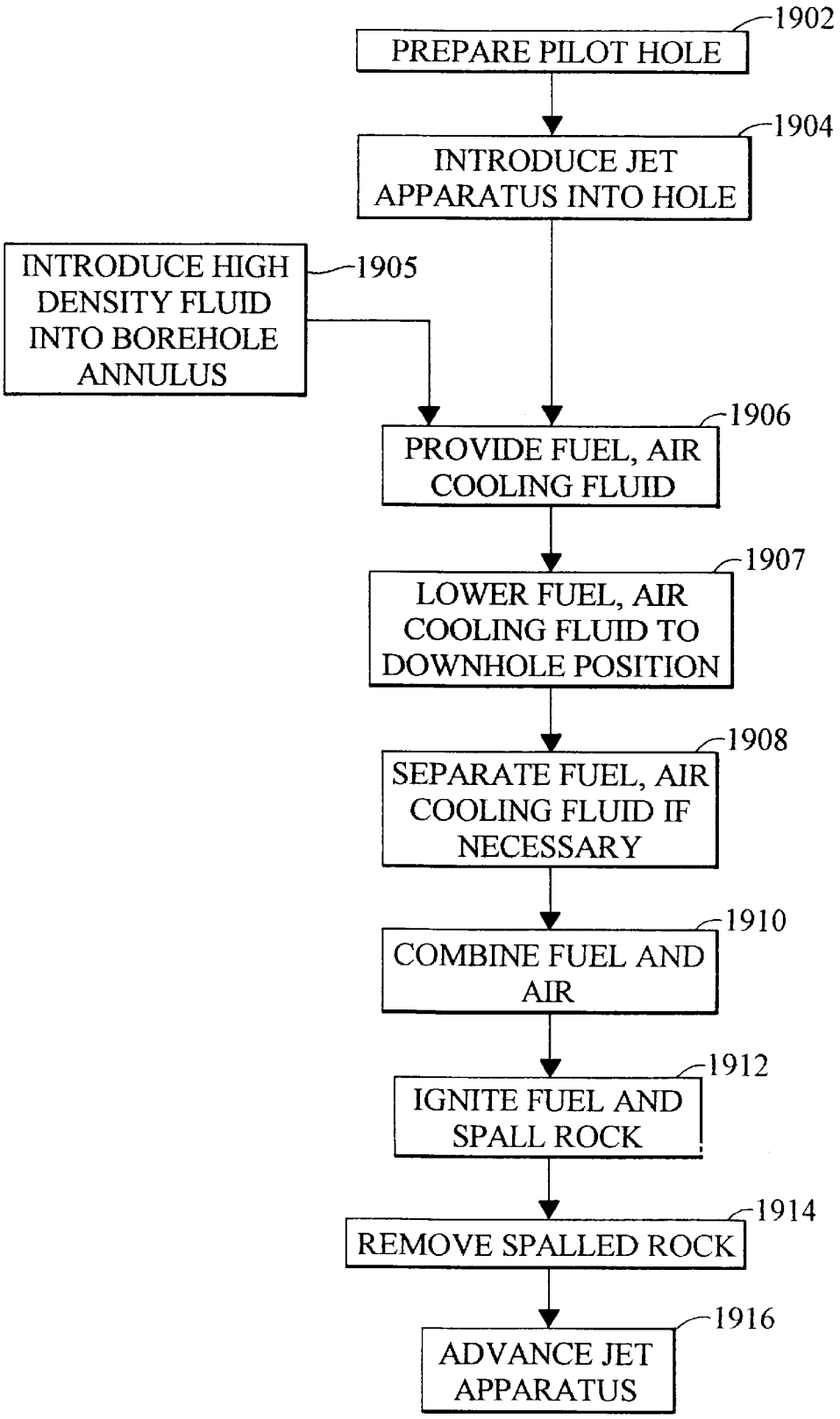
FIG. 19 shows schematically, in flow chart form, steps of a preferred embodiment of the method of the invention.

The invention also encompasses various embodiments of methods for removing rock using spallation. The general outline of the steps of the methods are shown in flow chart form in FIG. 19. A pilot hole is prepared 1902. The pilot hole may be prepared using conventional rotary drilling techniques or a spallation technique, depending on the type of material to be drilled. Typically, the near surface rocks are of a sedimentary nature and are more easily drilled by conventional techniques. The pilot hole is not made to the full depth of the hole to be drilled, and is cased to a depth necessary to isolate significant migration of ground water.

After the pilot hole has been made, the spallation flame jet housing head is introduced 1904 into the hole. Air and cooling fluid are introduced 1906 into the drilling apparatus, typically in a two component, two phase mixture, with the fuel being carried in a separate conduit as discussed above, although, if multiple conduits are used, then several different compositions of the components may be used. The step of introducing 1906 may be conventional introduction into the open end of a pipe, or may use the apparatus shown in FIGS. 10A, 10B and 11A–F, alternating between introducing the mixture to a pressurized pipe adding chamber 1018 and to a power swivel 1028, as new lengths of pipe are added between the power swivel and the pressurized chamber.

The fuel, air and cooling fluid are delivered 1907 to a down-hole location and separated 1908 if they have been previously combined. The fuel and air are combined or recombined 1910 and combusted 1912 to generate high temperature jets of a prescribed velocity. The jets issue from the rotating flame jet housing, heating the rock surface, causing rock pieces to spall away from the rock surface. The spalled rock pieces are removed 1914, typically by the momentum of the expanded combustion gases. Further lifting capacity is provided both by vaporization of the cooling fluid by the hot combustion gases and introduction of additional air. As the rock is spalled, the entire assembly is advanced 1916 further into the hole.

The entire process of providing the fuel mixture, combusting the fuel, spalling and removing the rock, and advancing the assembly into the hole continues, has all of the steps taking place at once at different locations along the fuel stream, until the desired hole depth is achieved.

If the high density hydro-combustion method is employed, then fluid of the desired, relatively high density is introduced 1905 into the annulus of the hole surrounding the drilling apparatus simultaneously with the step 1904 of introducing the apparatus into the hole.

If the electrokinetic apparatus of the invention is used, then only pressurized water is provided to the downhole apparatus. A small portion of the pressurized stream (working fluid) is directed into the resistance heating chamber. The remainder of the stream is expanded through the turbine, which generates electricity to heat the resistance heater, which in turn heats the water from the working fluid conduit. The hot, water forms the jet, which in turn spalls the rock. This spent stream is heat exchanged with the then down flowing working fluid. The cooled fluid and spalls are then mixed with the expanded turbine fluid and move to the surface in the borehole annulus.

EXAMPLES

To present an estimate of how the invention will change the nature of deep hard rock drilling, the concept of quarrying is useful. Past laboratory experiments and field experience have shown a rough relationship between the amount of rock removed by spallation and the thermal energy delivered by the flame jet over a rather large range of the energy.

One can define a quarrying rate, Q, as the volume rate of rock removed per unit time, per unit amount of thermal energy delivered by the jet expanded to atmospheric pressure and a stagnation temperature of ~1800° C. For the prior art, Q has a value of ~0.67 m$^3$/hr/MW with air flow ranging from ~30 SCFM (0.85 m$^3$/min) to ~2000 SCFM (56 m$^3$/min). This rate is achieved at jet heat transfer rates of ~1–5 Mw/m$^2$. Increases in heat transfer rates due to pressurization and other thermal efficiency gains can double Q in the low density embodiment and approach an order of magnitude increase in the high density embodiment. The potential increases in thermal efficiency may be due to: increase in heat transfer coefficient due to pressurization; annular, rotating configuration of hot jets; and avoiding overheating of the rock. How these increases in thermal efficiency will affect the quarrying rate Q is a very complicated issue but it is expected that at least a doubling of Q will occur.

Based on this value of Q of ~1.33 m$^3$/hr/MW, Table 1 shows the drilling velocities that will be achieved for the given borehole diameters.

TABLE 1

| HOLE DIAMETER | | STEADY DRILLING RATE | |
|---|---|---|---|
| inches | (meters) | ft/hr | (m/h) |
| 9 | (.23) | 80 | (24) |

TABLE 1-continued

| HOLE DIAMETER | | STEADY DRILLING RATE | |
|---|---|---|---|
| inches | (meters) | ft/hr | (m/h) |
| 12 | (.30) | 45 | (14) |
| 18 | (.46) | 20 | (5) |
| 24 | (.61) | 11 | (3) |

The thermal input of 1.5 MW needed to produce the quarrying rate is produced by the stoichiometric combustion of ~40 gal/hr (150 l/hr) of fuel oil with 1000 SCFM (28 $m^3$/min) of air. In the high density embodiment, a water flow of 210 gpm (800 l/m) would provide the transport medium.

One can compare the drilling velocity for a 12 inch hole with the velocity achieved by rotary drilling in deep hard rock environments (~5–15 ft/hr) (~1.5–4.6 m/hr). The 18" and 24" diameter would be considered very large and impossible to conventionally drill at 45 ft/hr, even with the largest rigs and present technology. Therefore, the present invention could achieve an order of magnitude improvement with velocities shown in Table 1. Further, conventional drilling is prone to disruptions and long periods of no drilling at all, while the present invention provides continuous hole formation.

For a standard hole formation velocity of 45 ft/hr (14 m/hr) the following table gives the needed flow rates for air, fuel, and water, transport (feed and return) tubing internal diameter and thermal power.

TABLE 2

| HOLE DIAMETER | | AIR | | WATER | | FUEL | | PIPE I.D. | | THERMAL POWER |
|---|---|---|---|---|---|---|---|---|---|---|
| in | (m) | SCFM | (m3/min) | gpm | (lpm) | gal/hr | (l/hr) | in | (m) | MW |
| 9 | (.23) | 560 | (16) | 120 | (450) | 22 | (85) | 3 | (.076) | .85 |
| 12 | (.30) | 1000 | (28) | 210 | (800) | 40 | (150) | 4 | (.10) | 1.5 |
| 18 | (.46) | 2250 | (63) | 475 | (1800) | 90 | (340) | 5 | (.13) | 3.4 |
| 24 | (.61) | 4000 | (112) | 840 | (3200) | 160 | (600) | 6 | (.15) | 6.0 |

These feed and return pipes produce a frictional pressure drop of ~100 psi/10000 ft (2.3 bar/1000 m). In the case of the electrokinetic embodiment, to achieve the 1.5 MW thermal input requires high flow rates at high pressure, being delivered to the down-hole turbine. Without the use of the down-hole heat exchanger, a flow rate of 1200 gpm (4500 l/m) would require an injection pressure ≧3000 psi (~200 bars). With a heat exchanger efficiency of 75%, these values could be reduced to 600 gpm (2250 l/m) and 1500 psi (100 bars). Both of these values are achievable from most rig pumps.

ECONOMIC CONSIDERATIONS

Figure 2:
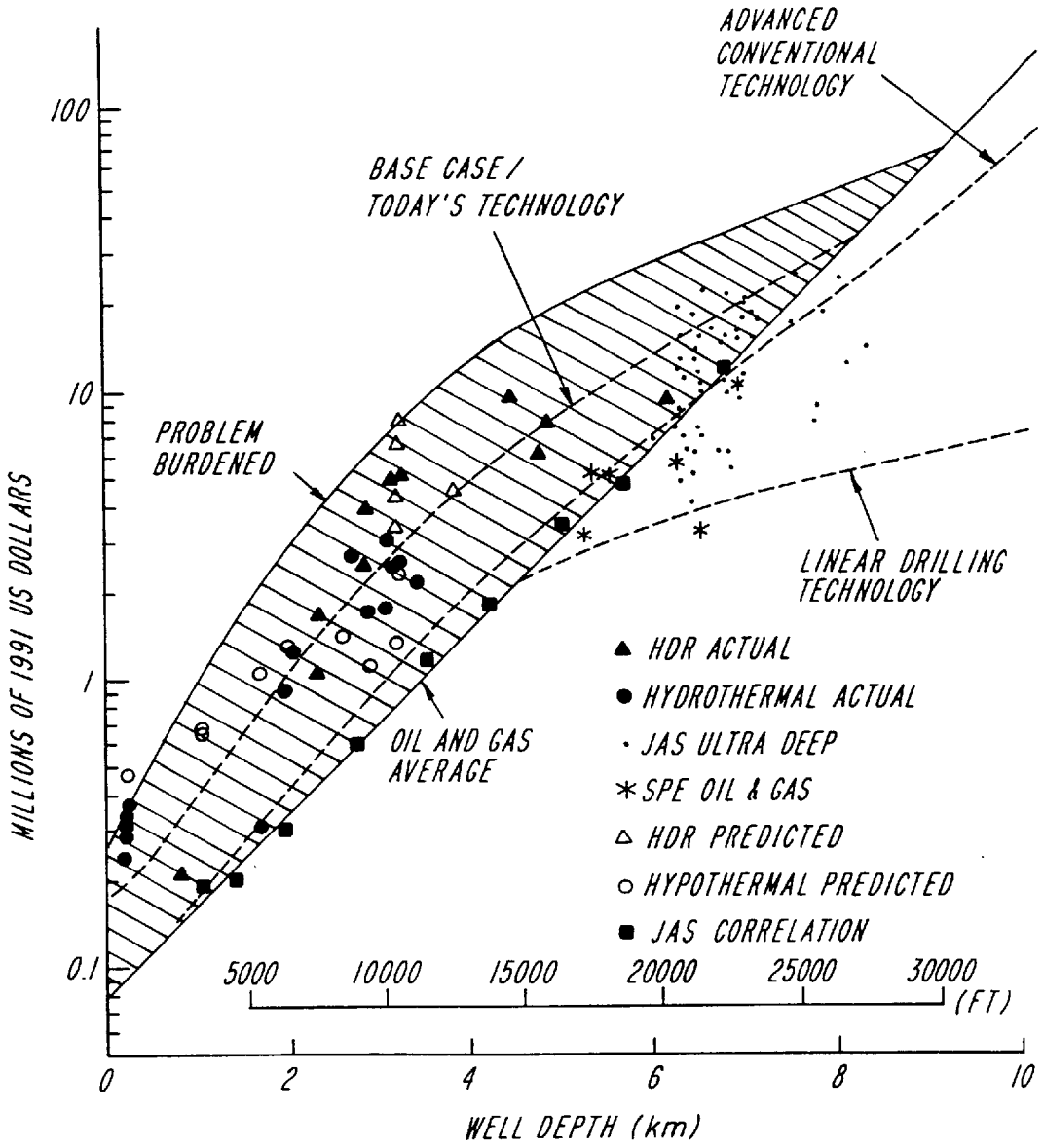
FIG. 2 is a graphical representation of the relation between hole depth and cost for a variety of conventional and theoretical methods of hole formation.

The spallation apparatus and techniques disclosed herein provide significant cost savings. It has been estimated that a thermally spalled, eight km (26,000 ft.) vertical wellbore of similar diameter using a rig with $20,000 to cover daily rental and operating costs, $500,000 for mobilization-demobilization, and an assumed drilling rate of 30 ft/hr (10 m/hr) would cost about $5 million (including contingency for a modest amount of rotary drilling) if the hole were spalled from the surface and $5.5 million if conventional method were needed to drill the first 2 km. As one can see from FIG. 2, these costs are a factor of four, or more lower than approximately $20 million for advanced conventional drilling techniques. In fact, spallation results in well costs that vary approximately linearly rather than exponentially with depth. This may be termed "linear cost excavating," and is identified by a dashed curve in FIG. 2 identified "Linear Drilling Technology."

As mentioned above, a spallation approach would dramatically reduce the number of round trips into and out of the hole, thus decreasing overall drilling time and costs. This change in drilling method should result in a fundamental shift away from an exponential to a near linear cost versus depth behavior.

In examining the potential for linear cost drilling estimated costs for the first four km of drilling are assumed to track with the exponential cost versus depth average line based on Joint Association Survey (JAS) data for oil and gas wells. Nonetheless, such a fundamental change in the cost-depth relationship would have enormous impact on the development of new oil, gas, and natural geothermal resources; it would open up markets for universal heat mining from deep hot dry rock, and permit scientific exploration of the earth's inner space—deep into the continental crust.

The various systems discussed must be maintained in proper working order for the apparatus of the invention to function properly. Due to the great distances between the surface and the down-hole excavation site, repair of any failed system (e.g., the various valves, seals, passageways, electric generators, microprocessors, etc.) would be virtually impossible without pulling the entire spallation string up to the surface. This is clearly undesirable.

To avoid the need for retrieval of any failed equipment to the surface, appropriate redundant features may beneficially be used. Whether or not such a feature should be employed is determined conventionally based on the probability of its failure, the cost of redundancy vs. the cost of failure, the available space for redundant systems, etc. In addition to redundant features, diagnostic devises can also be employed to provide early warning of incipient failures, in response to which remedial action can be taken. Certain down-hole repair systems, (such as filter flushing mechanisms) can also be incorporated into the design. None of these features have been included in any of the figures, due to the unnecessary complexity they would add. However, they are fully contemplated as part of the invention.

In conventional hole formation, great care is typically taken to isolate the surrounding fluid environment from that inside the wellbore, such as by casing the hole. In the present invention, where the great majority of the down-hole apparatus is not rotating, intrusion of water, or leakage of excavation products into the environment, is not that critical. Therefore, there need be less concern taken with ensuring isolation.

The described apparatus and method embodies all of the attributes of an ideal drilling instrument. It has the potential for a revolutionary new capacity; the ability to modify its present performance. Thus an ever increasing memory of geophysical and mechanical knowledge will be accumulated along with the knowledge of how to usefully fashion the environment with those properties.

The inventions described have evolved with an interest in the development of geothermal energy from deep, hot dry rock. A primary goal of this national program is to develop methods to economically extract thermal energy from the vast resource of the deep crystalline basement rocks. This is a technically successful project. There is a critical need for very substantial improvement in hard rock drilling technology. Modifications in conventional oil and gas drilling technology has allowed successful access to the deep thermal resources. However, the financial costs of these methods cast doubts on the economic viability of the entire concept. It has also been apparent that incremental improvements in existing drilling technology will not suffice—revolutionary change is needed.

The invention disclosed herein may also be useful in oil and gas production, as well as mining for minerals and metals.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Having described the invention, what is claimed is:

1. An apparatus for excavation of a borehole in a geological formation by spallation, said apparatus comprising:

a. a rotationally stationary support; and b. connected to said support and rotatable with respect thereto, a jet housing having a central axis, said housing comprising:

i. a plurality of jet nozzles, spaced circumferentially around said central axis, each arranged to emit a jet of hot fluid having a directional component that is radial with respect to said central axis and a directional component that is parallel to said central axis;

ii. at least one return passage therethrough for the passage of excavated material; and iii. a plurality of cooling fluid conduits distributed throughout said jet housing.

2. The apparatus of claim 1, said plurality of jet nozzles comprising at least three.

3. The apparatus of claim 1, said nozzles each further arranged such that said jet of hot fluid has a directional component that is perpendicular to a radius from said central axis.

4. The apparatus of claim 1, further comprising means for rotating said jet housing relative to said rotationally stationary support.

5. The apparatus of claim 4, said means for rotating said jet housing relative to said rotationally stationary support comprising an electric motor.

6. An apparatus for excavation of a borehole in a geological formation by spallation, said apparatus comprising:

a. a rotationally stationary support; and b. connected to said support and rotatable with respect thereto, a jet housing having a central axis, said housing comprising:

i. a plurality of jet nozzles, spaced circumferentially around said central axis, each arranged to emit a jet of hot fluid having a directional component that is radial with respect to said central axis and a directional component that is parallel to said central axis:

ii. at least one return passage therethrough for the passage of excavated material; and iii. a plurality of cooling fluid conduits, each having an exit port adjacent said return passage.

7. An apparatus for excavation of a borehole in a geological formation by spallation, said apparatus comprising:

a. a rotationally stationary support; and b. connected to said support and rotatable with respect thereto, a jet housing having a central axis, said housing comprising:

i. a plurality of jet nozzles, spaced circumferentially around said central axis, each arranged to emit a jet of hot fluid having a directional component that is radial with respect to said central axis and a directional component that is parallel to said central axis;

ii. at least one return passage therethrough for the passage of excavated material; and iii. a heat generation chamber.

8. The apparatus of claim 7, said heat generation chamber comprising a combustion chamber for the combustion of a chemical fuel.

9. The apparatus of claim 7, said heat generation chamber comprising an electric heating chamber for the heating of a working fluid.

10. The apparatus of claim 8, further comprising means for delivering a spark to said combustion chamber.

11. The apparatus of claim 8, further comprising:

a. a fluid flow conduit, through which fluid flows;

b. an electric heating element in said electric heating chamber; and c. a turbogenerator, the turbine of which is located in said fluid flow conduit, and the electric output of which is connected to said heating element.

12. The spallation apparatus of claim 11, further comprising means for isolating the environment around said spallation jet head from the environment between said jet head and the surface of said geological formation.

13. An apparatus for excavation of a borehole in a geological formation by thermal processes, said apparatus comprising:

a. a rotationally stationary support; and b. connected to said support and rotatable with respect thereto, a jet housing having a central axis, said housing comprising:

i. a plurality of jet nozzles, spaced circumferentially around said central axis, each arranged to emit a jet of hot fluid having a directional component that is parallel to said central axis;

ii. at least one return passage therethrough for the passage of excavated material; and iii. at least one combustion chamber that communicates with each of said jet nozzles.

14. The apparatus of claim 13, further comprising a return conduit connecting said return passage to the surface of said geological formation.

15. The apparatus of claim 13, further comprising a feed conduit connecting the surface of said geological formation to said plurality of jet nozzles.

16. The apparatus of claim 13, said plurality of jet nozzles being arranged at radially different locations.

17. The apparatus of claim 15, further comprising an air supply connected to said feed conduit.

18. The apparatus of claim 15, further comprising a water supply connected to said feed conduit.

19. The apparatus of claim 13, further comprising a fuel supply conduit connecting the surface of said geological formation to said combustion chamber.

20. The apparatus of claim 13, further comprising means for rotating the jet housing relative to the rotationally stationary support.

21. The apparatus of claim 13, said nozzles arranged to provide a substantially uniform heat flux over the surface area to be excavated.

22. The apparatus of claim 18, further comprising means for delivering water to the geological formation to be excavated.

23. The apparatus of claim 17, said nozzles arranged to provide a heat flux over the surface area to be excavated that is sufficient to cause fusion of said geological formation to be excavated.

24. An apparatus for excavation of a borehole in a geological formation by thermal processes, said apparatus comprising:

a. a rotationally stationary support; and b. connected to said support and rotatable with respect thereto, a jet housing having a central axis, said housing comprising:

i. a plurality of jet nozzles, spaced circumferentially around said central axis, each arranged to emit a jet of hot fluid having a directional component that is parallel to said central axis, said plurality of jet nozzles being arranged along a spiral; and ii. at least one return passage therethrough for the passage of excavated material.

25. A method for excavating a borehole in a geological formation, comprising the steps of:

a. excavating a pilot hole;

b. introducing a spallation apparatus into said pilot hole, said spallation apparatus comprising:

i. a rotationally stationary support; and ii. connected to said support, and rotatable with respect thereto, a jet housing having a central axis, said housing comprising:

(A). a plurality of jet nozzles, spaced circumferentially around said central axis, each arranged to emit a jet of hot fluid having a directional component that is radial with respect to said central axis and a directional component that is parallel to said central axis; and (B). at least one return passage therethrough for the passage of excavated material;

c. providing a working fluid to said jet housing through a conduit from the surface of said geological formation;

d. heating said working fluid to a temperature that will spall said rock formation;

e. emitting said hot fluid from said plurality of jet nozzles at an excavation site while rotating said jet housing relative to said rotationally stationary support and said pilot hole, thereby causing said geological formation to spall into chips;

f. removing said spalled chips from said excavation site through said return passage and a conduit to the surface of said geological formation; and g. advancing said jet housing deeper into said borehole being excavated.

26. The method of claim 25, further comprising, before the step of introducing said spallation apparatus into said pilot hole, the step of introducing into said pilot hole a fluid, and subsequently maintaining the borehole being formed substantially full of said fluid.

27. The method of claim 26, said fluid filling said borehole having a density approximately equal to that of water.

28. The method of claim 25, said working fluid comprising a mixture of air and water, further comprising, before the step of providing a working fluid to said jet housing, the step of separating said air from said water.

29. The method of claim 28, further comprising the step of providing a fuel supply to said jet housing.

30. The method of claim 29, said step of emitting comprising the step of combusting said fuel with said air.

31. The method of claim 28, said mass ratio of water to air $M_{H_2O}/M_{air}$ being between 1 and 10.

32. The method of claim 28, said mass ratio of water to air $M_{H_2O}/M_{air}$ being between 50 and 200.

33. A method for excavating a borehole in geological formation comprising the steps of:

a. excavating a pilot hole;

b. introducing a thermal apparatus into said pilot hole, said thermal apparatus comprising:

i. a rotationally stationary support;

ii. connected to said support and rotatable with respect thereto, a jet housing having a central axis, said housing comprising:

(A). a plurality of jet nozzles, spaced circumferentially around said central axis, each arranged to emit a jet of hot fluid having a directional component that is parallel to said central axis; and (B). at least one return passage therethrough for the passage of excavated geological formation;

c. providing a working fluid to said jet housing through a conduit from the surface of said geological formation;

d. heating said working fluid to a temperature that will cause fusion of said geological formation;

e. emitting said hot fluid from said plurality of jet nozzles at an excavation site while rotating said jet housing relative to said rotationally stationary support and said pilot hole, thereby causing said geological material to fuse;

f. removing said fused geological material from said excavation face through said return passage and a conduit to the surface of said geological formation; and g. advancing said jet housing deeper into said borehole being excavated.

34. The method of generating a hole of claim 33, further comprising the step of providing water to said excavation site along with said hot fluid.

35. The method of claim 33, further comprising, before the step of introducing said thermal apparatus into said pilot hole, the step of introducing into said pilot hole a fluid and maintaining said borehole being formed substantially full of said fluid.

* * * * *

UNITED STATES PATENT AND TRADEMARK OFFICE

CERTIFICATE OF CORRECTION

PATENT NO. : 5,771,984

DATED : June 30, 1998

INVENTOR(S) : Potter el al.

It is certified that error appears in the above-indentified patent and that said Letters Patent is hereby corrected as shown below:

Column 6, line 42, correction in text:

change "$M_{H_2O}/M_{air}$" to --$\dot{M}_{H_2O}/\dot{M}_{air}$ -- to read:

"The mass ratio of water to air $\dot{M}_{H_2O}/\dot{M}_{air}$".

Column 9, line 51, correction in text:

change "$M_{H_2O}/M_{air} \cong 2$" to --$\dot{M}_{H_2O}/\dot{M}_{air} \cong 2$-- to read:

"$\dot{M}_{H_2O}/\dot{M}_{air} \cong 2$ (between 1 and 10),".

Column 9, line 53, correction in text:

change "$M_{H_2O}/M_{air} \cong 100$" to --$\dot{M}_{H_2O}/\dot{M}_{air} \cong 100$-- to read:

"while for the high density embodiment specificaly discussed below, $\dot{M}_{H_2O}/\dot{M}_{air} \cong 100$".

UNITED STATES PATENT AND TRADEMARK OFFICE

CERTIFICATE OF CORRECTION

PATENT NO. : 5,771,984

DATED : June 30, 1998

INVENTOR(S) : Potter el al.

It is certified that error appears in the above-indentified patent and that said Letters Patent is hereby corrected as shown below:

Column 23, line 62, correction in text:

change "$M_{H_2O}/M_{air} \cong 2$" to --$\dot{M}_{H_2O}/\dot{M}_{air} \cong 2$-- to read:

"For a low density embodiment discussed above, $\dot{M}_{H_2O}/\dot{M}_{air} \cong 2$"

Column 23, line 64, correction in text:

change "$M_{H_2O}/M_{air} \cong 100$" to --$\dot{M}_{H_2O}/\dot{M}_{air} \cong 100$-- to read:

"while for the high density embodiment specifically discussed below $\dot{M}_{H_2O}/\dot{M}_{air} \cong 100$"

Column 38, line 19, correction in text:

change "$M_{H_2O}/M_{air}$" to --$\dot{M}_{H_2O}/\dot{M}_{air}$-- to read:

"said mass ratio of water to air $\dot{M}_{H_2O}/\dot{M}_{air}$ being between 1 and 10."

UNITED STATES PATENT AND TRADEMARK OFFICE

CERTIFICATE OF CORRECTION

PATENT NO. : 5,771,984

DATED : June 30, 1998

INVENTOR(S) : Potter el al.

It is certified that error appears in the above-indentified patent and that said Letters Patent is hereby corrected as shown below:

Column 38, line 21, correction in text:

change " $M_{H_2O}/M_{air}$ " to -- $\dot{M}_{H_2O}/\dot{M}_{air}$ -- to read:

"said mass ratio of water to air $\dot{M}_{H_2O}/\dot{M}_{air}$ being between 50 and 200."

Signed and Sealed this

Fourth Day of May, 1999

*Attest:*

*Attesting Officer*

Q. TODD DICKINSON

*Acting Commissioner of Patents and Trademarks*